US007748710B2

(12) United States Patent
Terada

(10) Patent No.: US 7,748,710 B2
(45) Date of Patent: Jul. 6, 2010

(54) SHEET-CONVEYING DEVICE

(75) Inventor: Kohei Terada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 570 days.

(21) Appl. No.: 11/613,418

(22) Filed: Dec. 20, 2006

(65) Prior Publication Data

US 2007/0145679 A1 Jun. 28, 2007

(30) Foreign Application Priority Data

Dec. 27, 2005 (JP) ..... 2005-376731

(51) Int. Cl.
*B65H 5/02* (2006.01)

(52) U.S. Cl. ..... 271/272; 271/277

(58) Field of Classification Search ..... 271/272, 271/277

See application file for complete search history.

(56) References Cited

U.S. PATENT DOCUMENTS

| | | | | |
|---|---|---|---|---|
| 5,110,104 | A * | 5/1992 | Wakao et al. | 271/3.03 |
| 5,210,616 | A * | 5/1993 | Kawasaki et al. | 358/296 |
| 5,954,327 | A * | 9/1999 | Lin et al. | 271/110 |
| 6,059,286 | A * | 5/2000 | Miyashita | 271/274 |
| 7,458,577 | B2 * | 12/2008 | Terada | 271/273 |
| 7,658,382 | B2 * | 2/2010 | Terada | 271/274 |
| 2007/0077080 | A1 | 4/2007 | Terada | |

FOREIGN PATENT DOCUMENTS

| | | | |
|---|---|---|---|
| EP | 1086820 | A2 | 3/2001 |
| JP | 2004-106345 | A | 4/2004 |
| JP | 2004-122609 | A | 4/2004 |
| JP | 2004-168451 | A | 6/2004 |

OTHER PUBLICATIONS

European Patent Office, European Search Report for Related EP Application No. 06026106, dated Feb. 27, 2007.

* cited by examiner

*Primary Examiner*—Patrick Mackey
*Assistant Examiner*—Howard Sanders
(74) *Attorney, Agent, or Firm*—Baker Botts L.L.P.

(57) ABSTRACT

A sheet-conveying device conveys a recording medium to a sheet support surface positioned downstream of the sheet-conveying device in a sheet-conveying direction when recording an image with an image-recording unit. A drive roller and a follower roller define a nip line therebetween. The nip line is positioned above the sheet support surface. A first support member rotatably supports the follower roller. A moving unit moves the first support member from a first position to a second position upstream of the first position in the paper-conveying direction immediately after a trailing edge of the recording medium leaves the sheet-conveying unit.

11 Claims, 18 Drawing Sheets

SHEET-CONVEYING DEVICE

CROSS REFERENCE TO RELATED APPLICATIONS

This application claims priority from Japanese Patent Application No. 2005-376731 filed Dec. 27, 2005. The entire content of the priority applications is incorporated herein by reference.

TECHNICAL FIELD

The disclosure relates to a sheet-conveying device for conveying a sheet-like recording medium to a sheet support surface for supporting the recording medium when an image-recording unit performs an image-recording operation thereon The disclosure also relates to an image-recording device equipped with the sheet-conveying device. The disclosure particularly relates to a structure for preventing the recording medium conveyed to the sheet support surface from floating up off the surface.

BACKGROUND

FIGS. 1(*a*)-1(*c*) show a portion of the internal structure in a conventional inkjet image-recording device. This image-recording device has a platen 102 for supporting a recording paper S, and a pair of conveying rollers 103 for conveying the recording paper S to the platen 102. The conveying roller 103 is configured of a drive roller 105 that is driven to rotate by a rotating force transmitted from a motor, and a follow roller 106 urged against the drive roller 105 by a coil spring 107.

This type of image-recording device conveys the recording paper S so that the recording paper S presses against the platen 102 in order to prevent the leading edge of the recording paper S from retroflexing and contacting nozzles in a recording head 100 at an image-recording position P. Specifically, a nip point Q between the drive roller 105 and follow roller 106 is set at a higher position than the top surface of the platen 102, as shown in FIG. 1(*a*). The follow roller 106 is pressed against the drive roller 105 in a slanted direction so that a common tangent L (see FIG. 2) to the drive roller 105 and follow roller 106 at the nip point Q intersects the top surface of the platen 102 at a prescribed inclination angle $\phi$. Accordingly, the recording paper S flexes downward pressing the leading edge of the recording paper S against the top surface of the platen 102, thereby reducing retroflexion in the leading edge of the recording paper S at the image-recording position P.

SUMMARY

However, at the instant the trailing edge of the recording paper S leaves the nip point Q when employing the mechanism described above, the conveying rollers 103 lose their hold on the recording paper S and, hence, no longer forcibly press the recording paper S downward. Accordingly, the recording paper S, which has been bent against the platen 102, has a tendency to straighten into its original unbent state, thereby floating upward. Regardless of whether the conveying rollers 103 lose their hold on the recording paper S, this floating may result from the trailing edge of the recording paper S being supported on the follow roller 106. Floating of the recording paper S modifies the gap between the recording surface of the recording paper S and the recording head 100, reducing recording quality. Floating may also cause the recording paper S to contact the recording head 100 and become stained. Floating is also more remarkable when using stiffer recording paper.

Japanese Patent Applications Nos. 2004-106345 and 2004-122609 propose paper float preventing devices for preventing floating in the trailing edge of recording paper when the trailing edge separates from the nip point. These devices are provided with a paper-regulating device for restricting the upward movement of floating recording paper.

However, since the float preventing devices disclosed in the above applications include the paper-regulating device disposed downstream of the drive roller and follow roller in the paper-conveying direction and near the platen, this device presses the recording paper into the top surface of the platen, applying a strong upward bending force of a prescribed curvature to the recording paper. This bending force gives the recording paper a strong tendency to retroflex upward, leading to an upward bend in the trailing edge of the recording paper that can reduce recording quality.

Further, by providing the paper-regulating device at a position near the platen and downstream of the drive roller and follow roller in the paper-conveying direction, it is necessary to increase the length of the platen or retract the recording head, carriage, guide rails, and other components disposed above the platen from the paper-regulating device in order to avoid interference between these components and the paper-regulating device. However, such measures will increase the size of the recording device.

In view of the foregoing, it is an object of the present invention to provide a sheet-conveying device capable of preventing a recording medium from floating when the trailing edge of the medium leaves a nip point between the drive roller and follow roller, without unnecessarily warping the recording medium and without increasing the size of the device. It is another object of the present invention to provide an image-recording device provided with the sheet-conveying device.

In order to attain the above and other objects, the invention provides a sheet-conveying device. The sheet-conveying device conveys a recording medium to a sheet support surface positioned downstream of the sheet-conveying device in a sheet-conveying direction when recording an image with an image-recording unit. The sheet-conveying device includes a sheet-conveying unit, a first support member, and a moving unit. The sheet-conveying unit has a drive roller and a follower roller defining a nip line therebetween. The nip line is positioned above the sheet support surface. The first support member rotatably supports the follower roller, and has an urging unit applying an urging force to the follower roller toward the drive roller to pinch the recording medium between the drive roller and the follower roller. The moving unit moves the first support member from a first position to a second position upstream of the first position in the paper-conveying direction immediately after a trailing edge of the recording medium leaves the sheet-conveying unit. The first position is a position in which a rotational axis of the follower roller is disposed upstream in the paper-conveying direction of a first vertical surface orthogonal to the sheet support surface and including a rotational axis of the drive roller. The first position provides a first nip line between the drive roller and the follower roller. The second position provides a second nip line between the drive roller and the follower roller. The second nip line is upstream of the first nip line in the sheet conveying direction. The second position is a position in which the surface of the follower roller does not intersect a second vertical plane orthogonal to the sheet support surface and extending parallel to an axis of the follower roller and including the first nip line.

According to another aspects, the invention provides an image-recording device. The image-recording device includes an image-recording unit, a sheet support surface, and a sheet-conveying device. On the sheet support surface, the image-recording unit records the image on a recording medium. The sheet-conveying device conveys a recording medium to the sheet support surface positioned downstream of the sheet-conveying device in a sheet-conveying direction. The sheet-conveying device includes a sheet-conveying unit, a first support member, and a moving unit. The sheet-conveying unit has a drive roller and a follower roller defining a nip line therebetween. The nip line is positioned above the sheet support surface. The first support member rotatably supports the follower roller, and has an urging unit applying an urging force to the follower roller toward the drive roller to pinch the recording medium between the drive roller and the follower roller. The moving unit moves the first support member from a first position to a second position upstream of the first position in the paper-conveying direction immediately after a trailing edge of the recording medium leaves the sheet-conveying unit. The first position is a position in which a rotational axis of the follower roller is disposed upstream in the paper-conveying direction of a first vertical surface orthogonal to the sheet support surface and including a rotational axis of the drive roller. The first position provides a first nip line between the drive roller and the follower roller. The second position provides a second nip line between the drive roller and the follower roller. The second nip line is upstream of the first nip line in the sheet conveying direction. The second position is a position in which the surface of the follower roller does not intersect a second vertical plane orthogonal to the sheet support surface and extending parallel to an axis of the follower roller and including the first nip line.

BRIEF DESCRIPTION OF THE DRAWINGS

Illustrative aspects in accordance with the invention will be described in detail with reference to the following figures wherein:

FIG. 14(*b*) is a cross-sectional view of the conveying rollers in the multifunction device after the trailing edge leaves the conveying rollers;

DETAILED DESCRIPTION

Figure 1A:
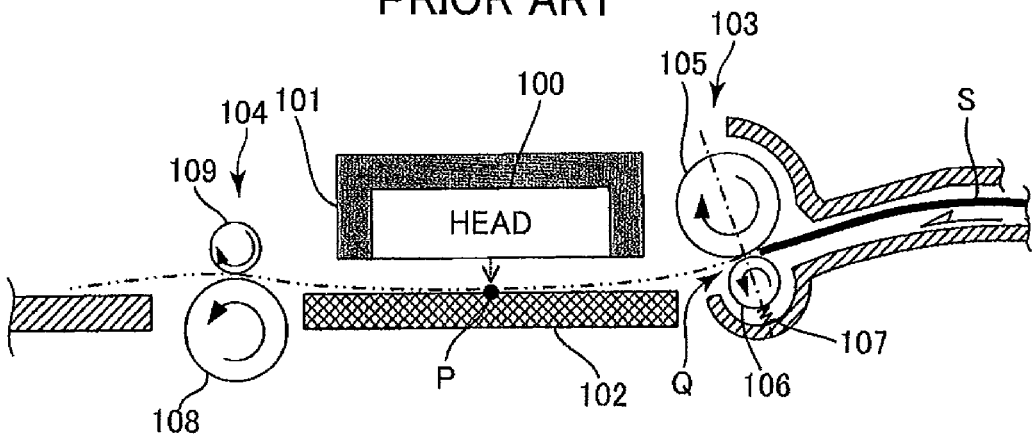
FIG.1(a) PRIOR ART
FIGS. 1(*a*)-1(*c*) are an explanatory diagram illustrating a conventional recording paper conveying mechanism.
Figure 1B:
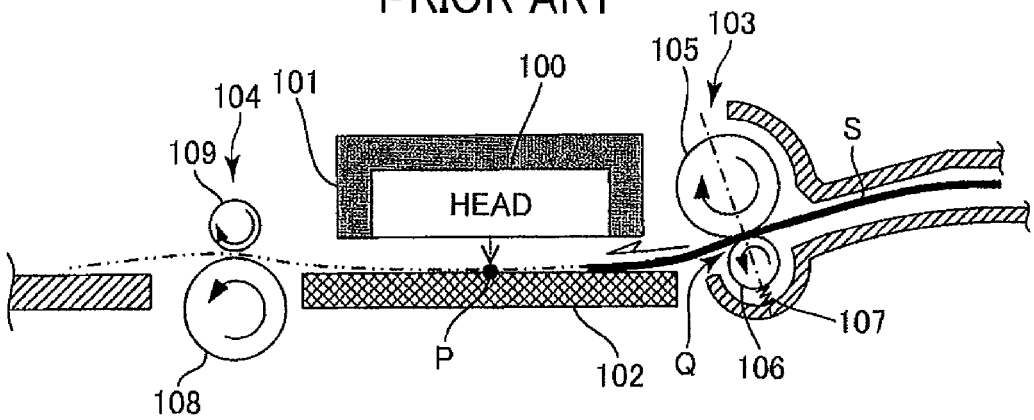
FIG.1(b) PRIOR ART
Figure 1C:
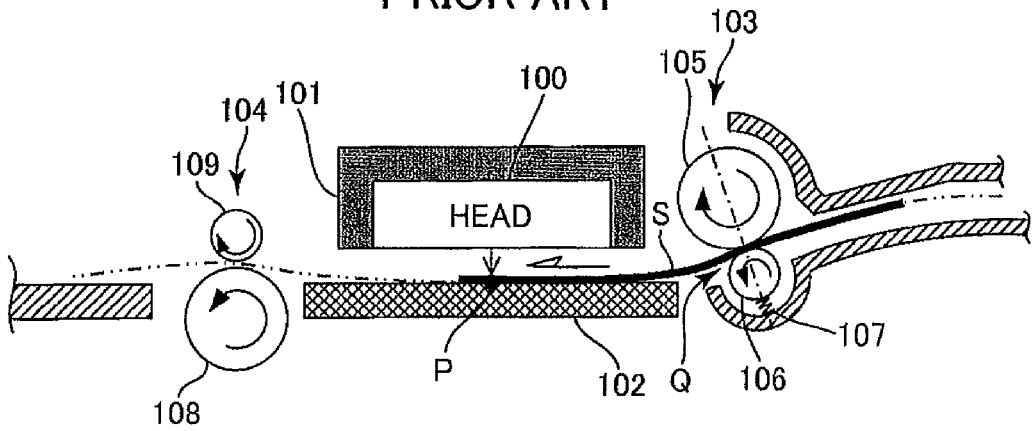
FIG.1(c) PRIOR ART
Figure 2:
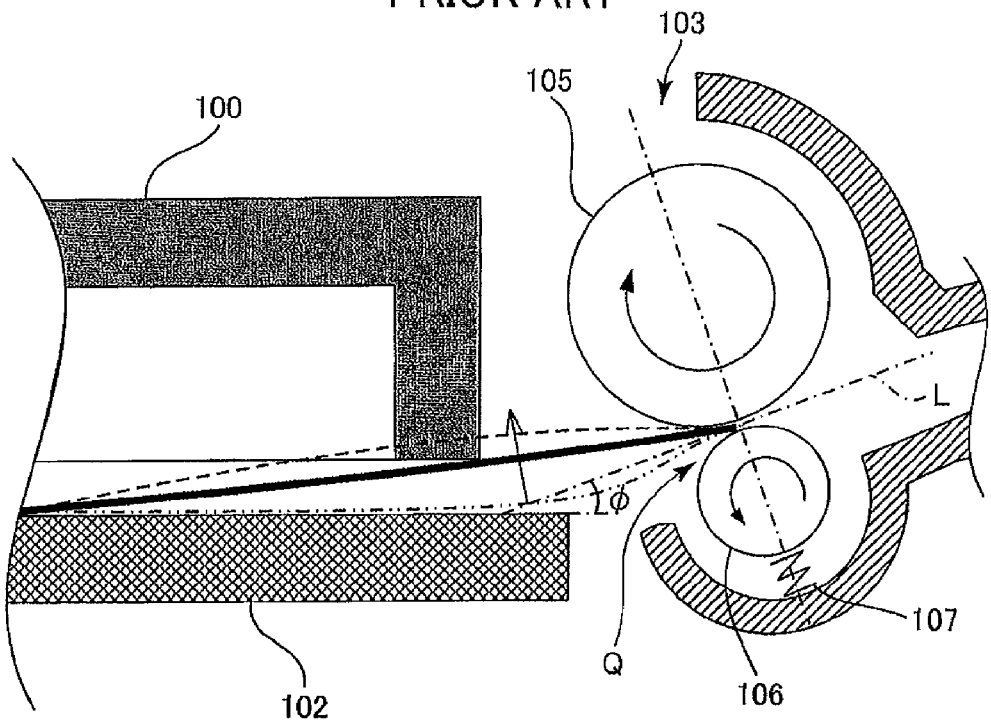
FIG.2 PRIOR ART
FIG. 2 is an enlarged view showing a conventional recording paper conveying mechanism.

A sheet-conveying device according to some aspects of the invention will be described while referring to the accompanying drawings wherein like parts and components are designated by the same reference numerals to avoid duplicating description.

Figure 3:
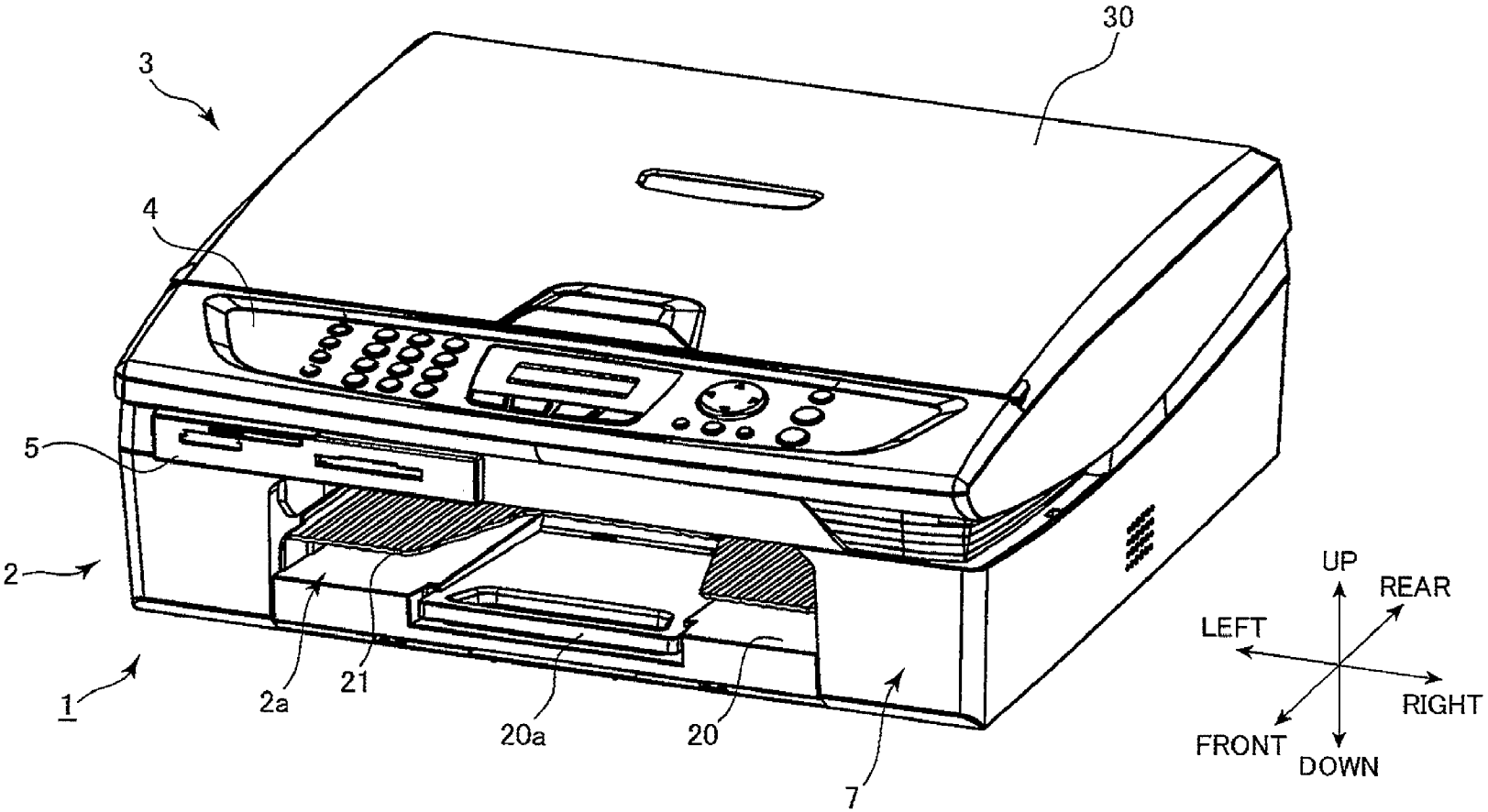
FIG. 3 is an external perspective view of a multifunction device.
Figure 4:
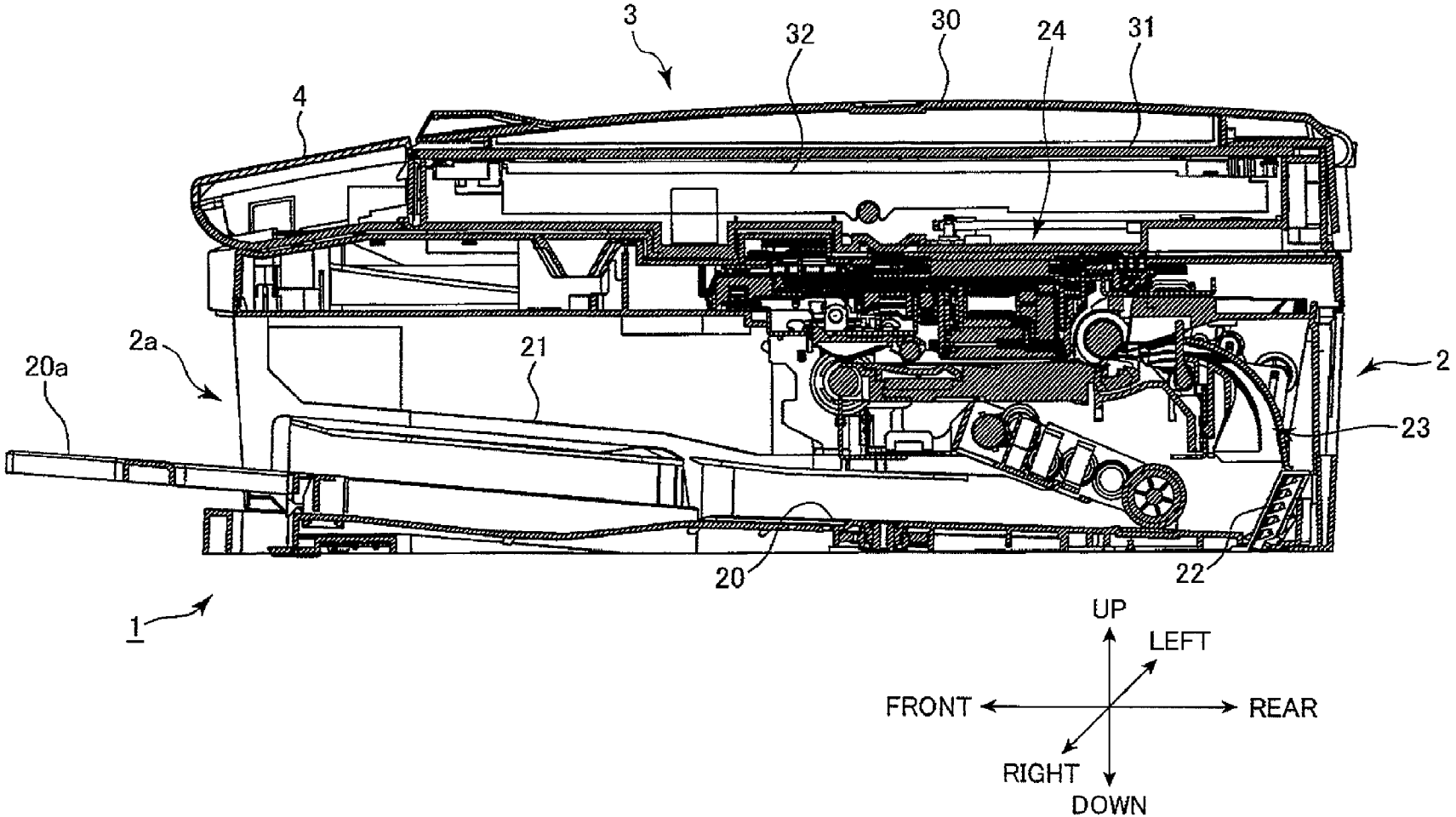
FIG. 4 is a vertical cross-sectional view showing the internal structure of the multifunction device.

FIG. 3 is a perspective view showing an external appearance of a multifunction device. The terms "upward", "downward", "right", "left", "front", "rear" and the like will be used throughout the description assuming that the multifunction device 1 is disposed in an orientation in which it is intended to be used, as shown in FIG. 3. FIG. 4 is a vertical cross-sectional view showing the internal structure of the multifunction device 1. The multifunction device 1 is integrally provided with a printer section 2 in the lower section and configured of an inkjet-recording device; and a scanner section 3 in the upper section, and possesses a printer function, scanner function, copier function, and facsimile function. Alternatively, it is possible to omit all functions from the multifunction device 1 except the printer function. For example, the multifunction device 1 may be configured as a stand-alone printer by omitting the scanner section 3.

The printer section 2 of the multifunction device 1 is primarily connected to a computer or other external information device for recording text and images on a recording paper based on print data including text or image data transmitted from the computer. The multifunction device 1 may also be connected to a digital camera and may record image data inputted from the digital camera on recording paper. Also, the multifunction device 1 may be loaded with a memory card or other storage medium and may be capable of recording image data stored on the storage medium on recording paper.

As shown in FIG. 3, the multifunction device 1 is substantially shaped as a thin rectangular parallelepiped with greater width and depth dimensions than the height dimension. The printer section 2 provided in the lower section of the multifunction device 1 has an opening 2*a* formed in the front surface thereof. A feeding tray 20 and a discharge tray 21 are stacked vertically in two levels in the opening 2*a*. The feeding tray 20 is capable of accommodating recording paper of various sizes as large as the A4 size and including the B5 size and postcard size. The feeding tray 20 includes a slidable tray 20*a* that can be pulled outward when needed, as shown in FIG. 4, to expand the surface area of the tray. With this construction, the feeding tray 20 can accommodate legal sized recording paper, for example. Recording paper accommodated in the feeding tray 20 is supplied into the printer section 2 to undergo a desired image recording process, and is subsequently discharged onto the discharge tray 21.

The scanner section 3 disposed in the upper section of the multifunction device 1 is a flatbed scanner. As shown in FIGS. 3 and 4, the multifunction device 1 includes an original cover 30 on the top thereof that is capable of opening and closing, and a platen glass 31 and an image sensor 32 disposed below the original cover 30. The platen glass 31 functions to support an original document when an image on the document is being scanned. The image sensor 32 is disposed below the platen glass 31 and is capable of reciprocating in the width direction of the multifunction device 1 (left-to-right direction), wherein the sub scanning direction of the image sensor 32 is the front-to-rear direction of the multifunction device 1.

A control panel 4 is provided on the top front surface of the multifunction device 1 for operating the printer section 2 and the scanner section 3. The control panel 4 is configured of various operating buttons and a liquid crystal display. The multifunction device 1 operates based on operating instructions inputted through the control panel 4 and, when connected to an external computer, operates based on instructions that the computer transmits through a printer driver or a scanner driver. As shown in FIG. 3, a slot section 5 in which various small memory cards or other storage media can be inserted is provided in the upper left section of the multifunction device 1 on the front surface thereof. A user can input operating instructions via the control panel 4 to read image data stored on a memory card that is inserted into the slot section 5 and to display the image data on the liquid crystal display of the control panel 4, and can further input instructions to record a desired image on recording paper using the printer section 2.

Next, the internal structure of the multifunction device 1, and particularly the structure of the printer section 2, will be described with reference to FIGS. 3-7. As shown in FIG. 4, a sloped separating plate 22 is disposed near the rear side of the feeding tray 20 provided in the lower section of the multifunction device 1 for separating recording paper stacked in the feeding tray 20 and guiding the separated paper upwards A paper-conveying path 23 leads upward from the sloped separating plate 22, curves toward the front of the multifunction device 1, and extends in the rear-to-front direction therefrom. The paper-conveying path 23 passes an image-recording unit 24 and leads to the discharge tray 21. Hence, the paper-conveying path 23 guides recording paper conveyed from the feeding tray 20 along U-shaped path that curves upward and back in the opposite direction to the image-recording unit 24. After the image-recording unit 24 has recorded an image on the paper, the paper continues along the paper-conveying path 23 and is discharged onto the discharge tray 21.

Figure 5:
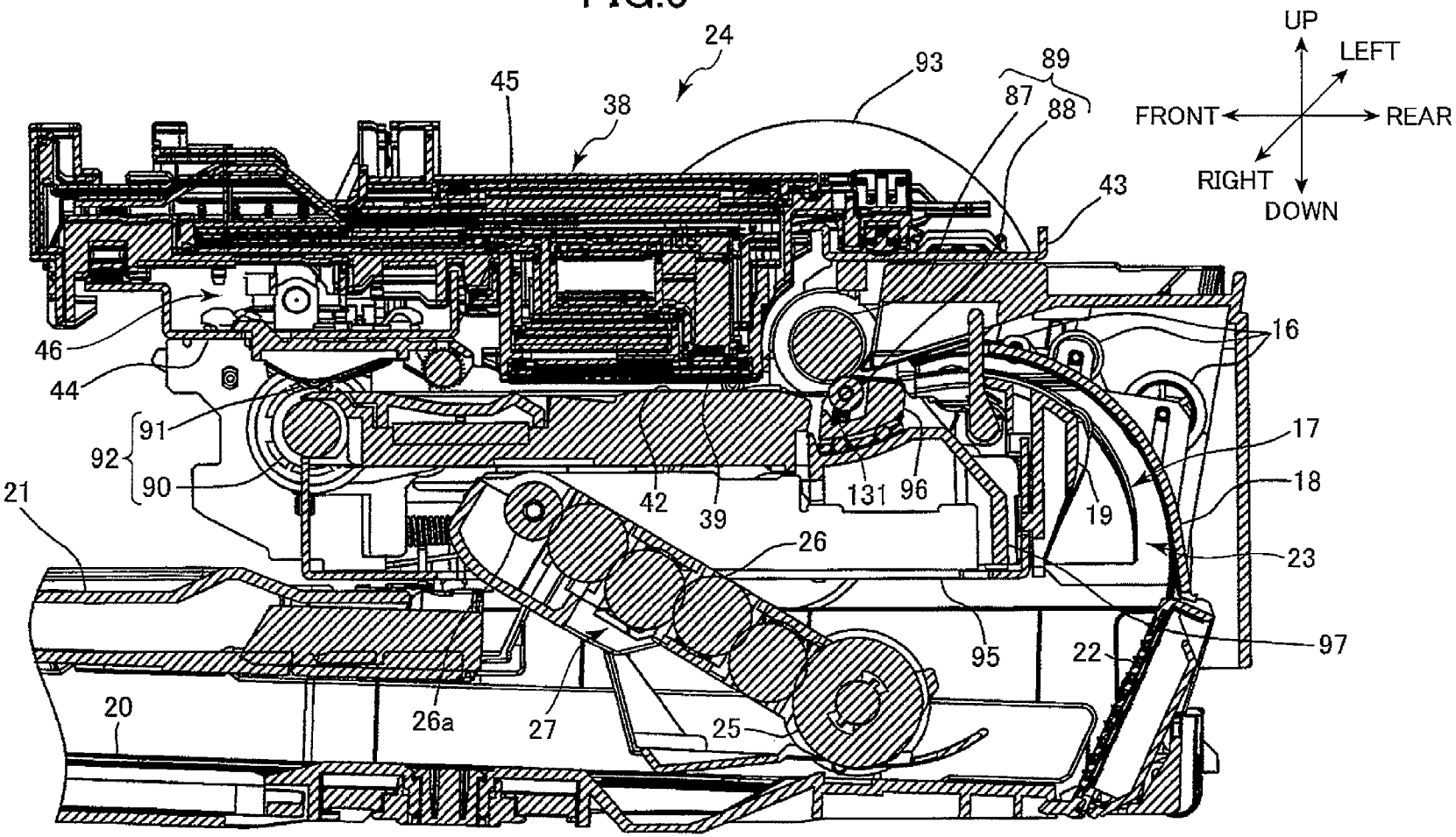
FIG. 5 is an enlarged cross-sectional view showing the primary structure of a printer section in the multifunction device.

FIG. 5 is an enlarged cross-sectional view showing the principal structure of the printer section 2. As shown in FIG. 5, a feeding roller 25 is disposed above the feeding tray 20 for feeding recording paper stacked in the feeding tray 20 to the paper-conveying path 23. The feeding roller 25 is supported on an end of a feeding arm 26. A linefeed motor 71 (see FIG. 8) drives the feeding roller 25 to rotate with a driving force transmitted to the feeding roller 25 via a drive transmitting mechanism 27. The drive transmitting mechanism 27 includes a plurality of engaged gears.

The feeding arm 26 is rotatably supported on a base end 26*a*. When the feeding arm 26 pivots about the base end 26*a*, the feeding roller 25 moves vertically so as to contact and separate from the feeding tray 20. As shown in FIG. 5, the feeding arm 26 is urged to rotate downward into contact with the feeding tray 20 by its own weight or a spring, and retracts upward when the feeding tray 20 is inserted or removed. When the feeding arm 26 is pivoted downward, the feeding roller 25 supported on the end of the feeding arm 26 contacts the recording paper in the feeding tray 20 with pressure. As the feeding roller 25 rotates in this position, a frictional force generated between the surface of the feeding roller 25 and the recording paper conveys the topmost sheet of the recording paper toward the sloped separating plate 22. The leading edge of this sheet of recording paper contacts the sloped separating plate 22 and is guided upward by the sloped separating plate 22 onto the paper-conveying path 23. In some cases, when the feeding roller 25 is conveying the topmost sheet of recording paper, friction or static electricity between the topmost sheet and the underlying sheet causes the underlying sheet to be conveyed together with the topmost sheet. However, the underlying sheet is restrained when contacting the sloped separating plate 22.

Excluding the section in which the image-recording unit 24 are provided, the paper-conveying path 23 is configured of an outer guide surface and an inner guide surface that oppose each other with a prescribed gap formed therebetween. For example, a curved section 17 of the paper-conveying path 23 may be configured near the rear side of the multifunction device 1 by fixing an outer guide member 18 and an inner guide member 19 to a frame of the multifunction device 1. Rollers 16 are provided along the paper-conveying path 23, and particularly in the curved section of the paper-conveying path 23. The rollers 16 are rotatably provided on axes extending in the width direction of the paper-conveying path 23. The surfaces of the rollers 16 are exposed from the outer guide surface. These rollers 16 facilitate the smooth conveyance of recording paper in the curved section of the paper-conveying path 23.

As shown in FIGS. 4 and 5, the image-recording unit 24 is disposed on the paper-conveying path 23. The image-recording unit 24 includes a carriage 38 that reciprocates in a main scanning direction that is parallel to the left-to-right direction, and an inkjet recording head 39 mounted in the carriage 38. Ink cartridges disposed in the multifunction device 1 independently of the inkjet recording head 39 supply ink in the colors cyan (C), magenta (M), yellow (Y), and black (Bk) to the inkjet recording head 39 via ink tubes 41 (see FIG. 6). While the carriage 38 reciprocates, microdroplets of ink in these colors are selectively ejected from the inkjet recording head 39 onto the recording paper conveyed over a platen 42 to record an image on the paper. Note that the ink cartridge is not shown in FIGS. 5 and 6.

Figure 6:
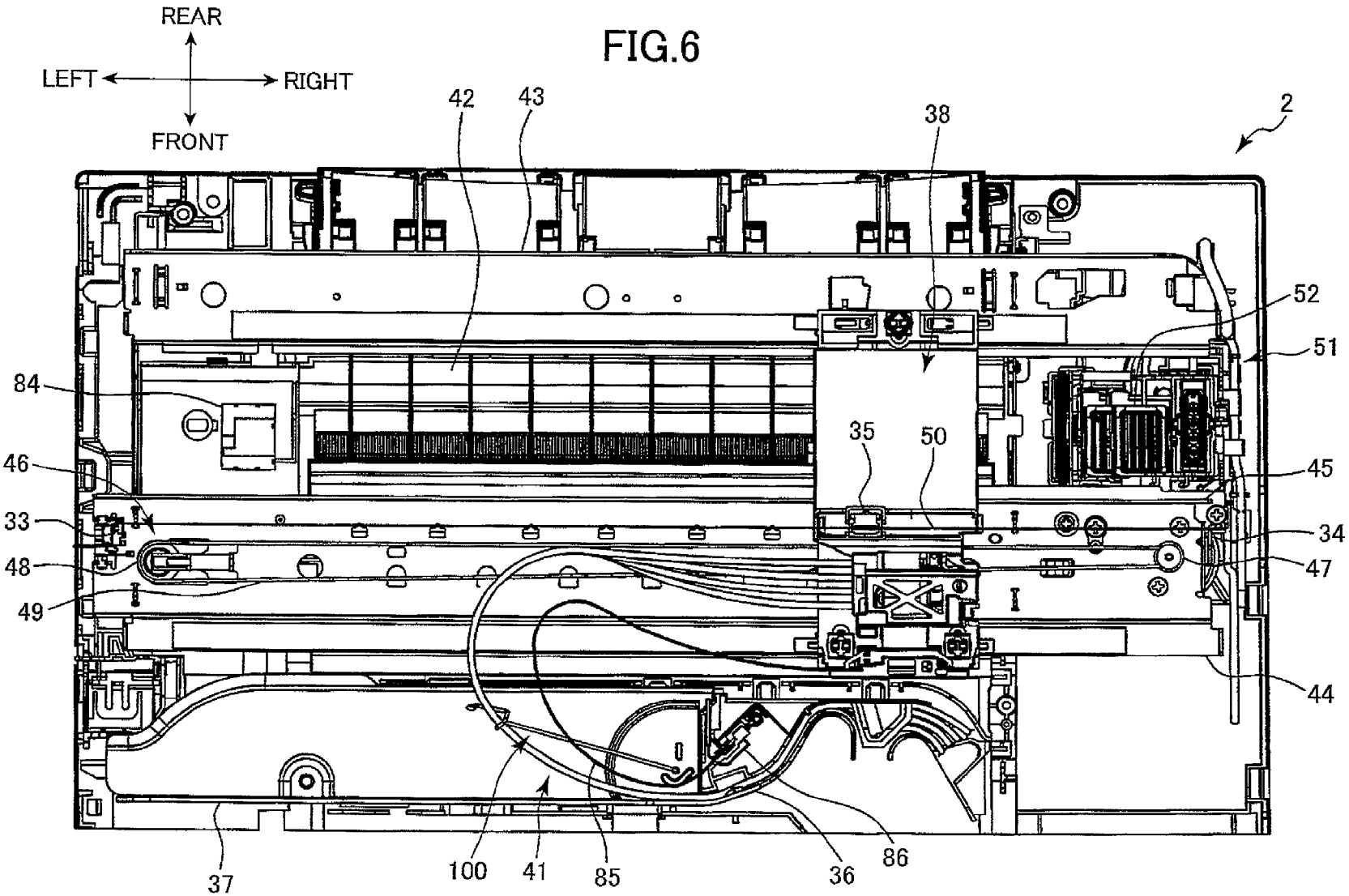
FIG. 6 is a plan view of the printer section.
Figure 7:
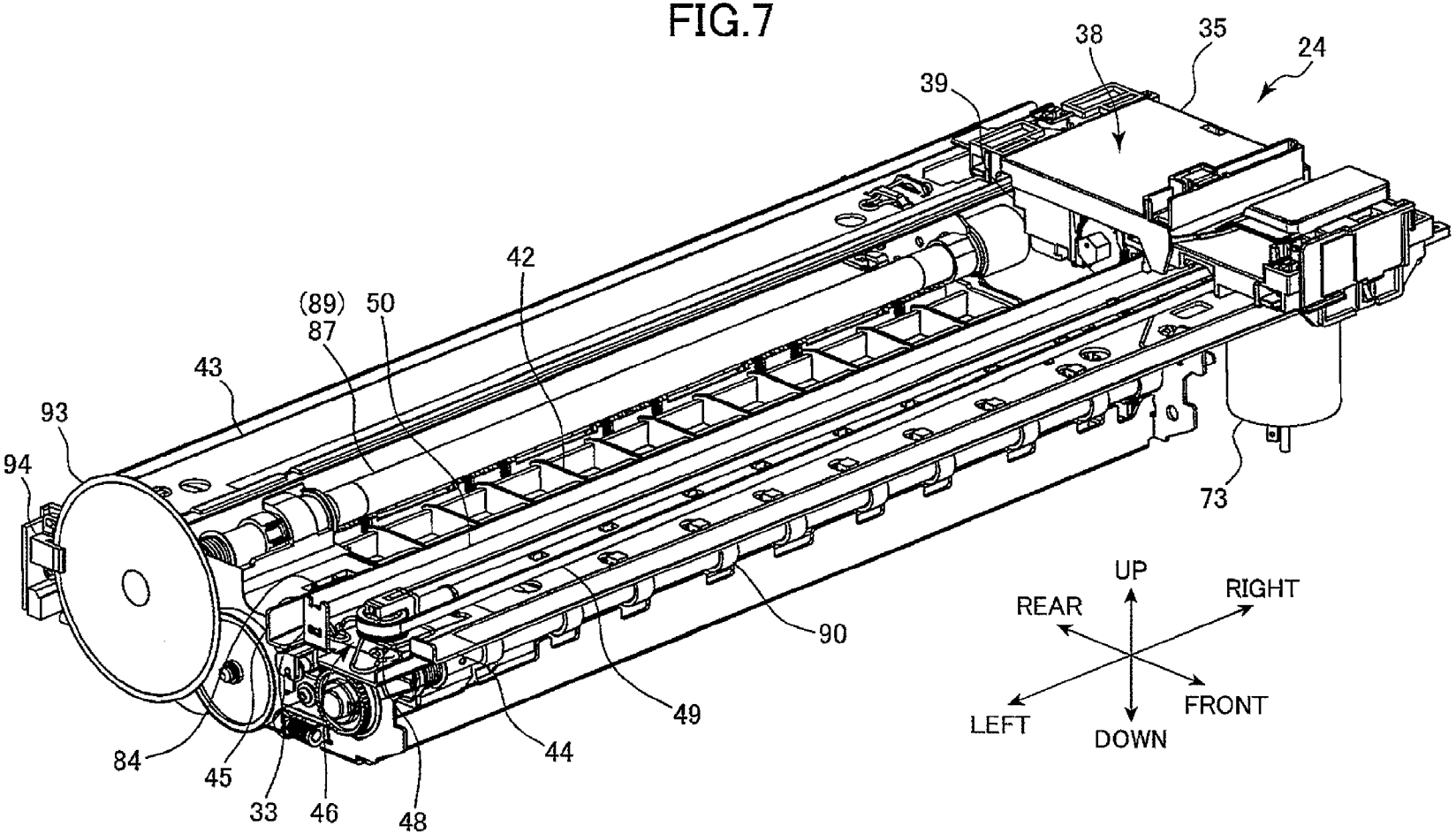
FIG. 7 is a perspective view showing the structure around an image-recording unit.

FIG. 6 is a plan view showing the principal structure of the printer section 2, and primarily the structure from approximately the center of the printer section 2 to the rear surface side thereof. FIG. 7 is a perspective view showing the structure of the image-recording unit 24 in the printer section 2. As shown in FIGS. 6 and 7, a pair of guide rails 43 and 44 is disposed above the paper-conveying path 23. The guide rails 43 and 44 are disposed at a prescribed distance from each other in the paper-conveying direction of the paper-conveying path 23 (front-to-rear direction) and extend in the width direction (left-to-right direction) orthogonal to the upper side of the paper-conveying direction. The guide rails 43 and 44 are disposed inside the casing of the printer section 2 and constitute part of the frame supporting components of the printer section 2. The carriage 38 is disposed across both the guide rails 43 and 44 so as to be capable of sliding in a direction orthogonal to the paper-conveying direction. Accordingly, the guide rails 43 and 44 are disposed so as to be substantially horizontal and are juxtaposed in the paper-conveying direction, thereby decreasing the height of the printer section 2 and achieving a thinner device.

The guide rail 43 disposed on the upstream side of the guide rail 44 in the paper-conveying direction is plate-shaped with a dimension in the width direction (left-to-right direction) of the paper-conveying path 23 greater than the reciprocating range of the carriage 38. The guide rail 44 disposed on the downstream side is also plate-shaped with a dimension in the width direction of the paper-conveying path 23 substantially the same as that of the guide rail 43. The carriage 38 is capable of sliding in the longitudinal direction of the guide rails 43 and 44 with an upstream end of the carriage 38 supported on the guide rail 43 and a downstream end supported on the guide rail 44. The guide rail 44 has an edge part 45 bent upward at substantially a right angle from the upstream side of the guide rail 44. The carriage 38 supported on the guide rails 43 and 44 has a pair of rollers or other gripping members for slidably gripping the edge part 45. Hence, the carriage 38 can slide in a direction orthogonal to the paper-conveying direction, while being positioned in the paper-conveying direction. In other words, the carriage 38 is slidably supported on the guide rails 43 and 44 and is capable of reciprocating in a direction orthogonal to the paper-conveying direction with the edge part 45 of the guide rail 44 serving as a positional reference. Although not shown in the drawings, a lubricating agent such as grease is applied to the edge part 45 to facilitate sliding of the carriage 38.

A belt drive mechanism 46 is provided on the top surface of the guide rail 44, The belt drive mechanism 46 is configured of a drive pulley 47 and a follow pulley 48 disposed near widthwise ends of the paper-conveying path 23, and an endless timing belt 49 stretched around the drive pulley 47 and follow pulley 48 and having teeth on the inside surface thereof. A carriage motor 73 (see FIG. 6) generates a driving force that is transmitted to the shaft of the drive pulley 47 for rotating the drive pulley 47, The rotation of the drive pulley 47 causes the timing belt 49 to move circuitously. Although the timing belt 49 is an endless belt in the multifunction device 1, a belt having ends may also be used by fixing both ends to the carriage 38.

The bottom surface of the carriage 38 is fixed to the timing belt 49 so that the circuitous movement of the timing belt 49 causes the carriage 38 to reciprocate over the guide rails 43 and 44 while the edge part 45 maintains the position of the carriage 38 relative to the paper-conveying direction. The inkjet recording head 39 is mounted in the carriage 38 having this construction so that the inkjet recording head 39 also reciprocates in the width direction. Here, the width direction is the main scanning direction.

As shown in FIG. 6, an encoder strip 50 for a linear encoder 77 (see FIG. 8) is provided along the guide rail 44. The encoder strip 50 is a strip-like member formed of a transparent resin. A pair of support parts 33 and 34 is formed on the top surface of the guide rail 44, with one disposed on each widthwise end of the guide rail 44 (each end in the reciprocating direction of the carriage 38). The encoder strip 50 extends over the edge part 45 with the ends of the encoder strip 50 engaged in the support parts 33 and 34. While not shown in the drawings, one of the support parts 33 and 34 has a leaf spring for engaging the end of the encoder strip 50. The leaf spring prevents slack in the encoder strip 50 by applying tension to the encoder strip 50 in the longitudinal direction, while being elastically deformable so that the encoder strip 50 can bend when an external force is applied thereto.

Light-transmitting parts allowing the passage of light and light-blocking parts preventing the passage of light are alternately disposed along the length of the encoder strip 50 at a prescribed pitch. An optical sensor 35 configured of a transmission sensor is disposed on the top surface of the carriage 38 at a position opposing the encoder strip 50. The optical sensor 35 reciprocates together with the carriage 38 along the length of the encoder strip 50 and detects the pattern formed on the encoder strip 50. A head controlling circuit board is provided in the inkjet recording head 39 for controlling ink ejection. The head controlling circuit board outputs a pulse signal based on detection signals from the optical sensor 35. By determining the position of the carriage 38 based on this pulse signal, it is possible to control the reciprocating motion of the carriage 38. The head controlling circuit board is covered by a head cover of the carriage 38 and is therefore not visible in FIGS. 6 and 7.

As shown in FIGS. 5-7, the platen 42 is disposed on the bottom of the paper-conveying path 23 opposing the inkjet recording head 39, The platen 42 spans a central portion within the reciprocating range of the carriage 38 through which the recording paper passes. The width of the platen 42 is sufficiently larger than the maximum width of recording paper that can be conveyed in the multifunction device 1 so that both widthwise edges of the recording paper pass over the platen 42. The platen 42 is disposed so that a supporting surface 42*a* (see FIG. 13) is parallel to the installation surface of the multifunction device 1.

As shown in FIG. 6, a maintenance unit including a purge mechanism 51 and a waste ink tray 84 is provided in a region through which the recording paper does not pass, that is, in a region outside the image-recording range of the inkjet recording head 39. The purge mechanism 51 functions to draw out air bubbles and foreign matter from nozzles 53 (not shown) in the inkjet recording head 39 (FIG. 7). The purge mechanism 51 includes a cap 52 for covering the nozzles 53, a pump mechanism (not shown) connected to the inkjet recording head 39 via the cap 52, and a moving mechanism (not shown) for moving the cap 52 to contact or separate from the nozzles 53 of the inkjet recording head 39. In FIGS. 6 and 7, the pump mechanism and the moving mechanism are positioned beneath the guide rail 44 and are therefore not visible. When an operation is performed to remove air bubbles from the inkjet recording head 39, the carriage 38 is moved so that the inkjet recording head 39 is positioned above the cap 52. Subsequently, the moving mechanism moves the cap 52 upward against the inkjet recording head 39 so as to form a seal over the nozzles 53 formed in the bottom surface of the inkjet recording head 39. The pump mechanism then generates negative pressure in the cap 52 to draw out ink and air bubbles and foreign matter included in the ink from the nozzles 53.

The waste ink tray 84 is disposed on the top surface of the platen 42 outside of the image-recording range, but within the reciprocating range of the carriage 38 for receiving ink that has been flushed out of the inkjet recording head 39. The inside of the waste ink tray 84 is lined with felt for absorbing and holding the flushed ink. The maintenance unit having this construction can perform such maintenance as removing air bubbles and mixed ink of different colors from the inkjet recording head 39, and preventing the inkjet recording head 39 from drying out As shown in FIG. 3, a door 7 is provided on the front surface of the printer section 2 casing and is capable of opening and closing over the same. Opening the door 7 exposes a cartridge mounting section on the front side of the printer section 2, enabling the user to mount ink cartridges in or remove ink cartridges from the cartridge mounting section. While not shown in the drawings, the cartridge mounting section is partitioned into four accommodating chambers for individually accommodating ink cartridges filled with ink of the colors cyan, magenta, yellow, and black. As shown in FIG. 6, four ink tubes 41 corresponding to the four ink colors lead from the cartridge accommodating section to the carriage 38. Ink is supplied from the ink cartridges mounted in the cartridge accommodating section to the inkjet recording head 39 mounted on the carriage 38 via the ink tubes 41.

The ink tubes 41 are tubes formed of synthetic resin and are flexible so as to be able to bend when the carriage 38 reciprocates. As shown in FIG. 6, the ink tubes 41 extend from the cartridge accommodating section along the width direction of the device to a position near the center thereof, at which position the ink tubes 41 are fixed to a fixing clip 36 on the body of the device. A section of the ink tubes 41 from the fixing clip 36 to the carriage 38 forms a U-shaped curve that is not fixed to the device body. This U-shaped section changes in shape as the carriage 38 reciprocates. The section of the ink tubes 41 extending from the fixing clip 36 to the cartridge mounting section is not shown in FIG. 6.

Specifically, the section of the ink tubes 41 between the fixing clip 36 and carriage 38 leads in one direction along the reciprocating path of the carriage 38 and subsequently reverses directions, forming a curved section. In other words, this section of the ink tubes 41 is substantially U-shaped in a plan view. At the carriage 38, the four ink tubes 41 are horizontally juxtaposed along the paper-conveying direction and extend in the reciprocating direction of the carriage 38. However, the four ink tubes 41 are arranged vertically at the fixing clip 36 to facilitate fixation. The fixing clip 36 has a U-shaped cross-section open on the top. The vertically stacked ink tubes 41 are inserted through this opening and are integrally held by the fixing clip 36. In this way, the four ink tubes 41 curve along a U-shaped path from the carriage 38 to the fixing clip 36 while twisting from a horizontally juxtaposed relationship to a vertically juxtaposed relationship.

The four ink tubes 41 have substantially the same length from the carriage 38 to the fixing clip 36. The ink tube 41 positioned farthest upstream in the paper-conveying direction at the carriage 38 is positioned on the top at the fixing clip 36. The ink tube 41 disposed next in order from the upstream side at the carriage 38 is disposed next in order vertically at the fixing clip 36. This process is repeated so that the ink tubes 41 arranged from the upstream side to the downstream side in the paper-conveying direction at the carriage 38 are arranged in order from top to bottom at the fixing clip 36. Being substantially equivalent in length, the ink tubes 41 curve so that the center of the curved section of each ink tube 41 is offset in the paper-conveying direction according to the order in which the ink tubes 41 are juxtaposed in the paper-conveying direction. As a result, the four ink tubes 41 have a vertically sloped arrangement in the curved section, thereby minimizing interference among the ink tubes 41 as the ink tubes 41 change shape to follow the reciprocating motion of the carriage 38. In the multifunction device 1, four of the ink tubes 41 are provided. However, even if the number of the ink tubes 41 is increased, the ink tubes 41 can be arranged in the same juxtaposed relationship, with the ink tube 41 disposed farthest upstream in the paper-conveying direction at the carriage 38 positioned on top at the fixing clip 36.

A flat cable 85 transfers recording signals from a main circuit board constituting a controller 64 (see FIG. 8) to a head control circuit board in the inkjet recording head 39. While not shown in FIG. 6, the main circuit board is disposed near the front of the printer section 2. The flat cable 85 is an insulated ribbon cable configured of conductors for transmitting electric signals, the conductors being coated in a synthetic resin film such as a polyester film. The flat cable 85 electrically connects the main circuit board to the head control circuit board.

The flat cable 85 is flexible and bends in response to the reciprocation of the carriage 38. As shown in FIG. 6, the flat cable 85 extends from the carriage 38 in one direction along the reciprocating path of the carriage 38, and subsequently reverses directions and extends to a fixing clip 86, thereby forming a curved section. In other words, the flat cable 85 follows a path that is substantially U-shaped in a plan view with the top and bottom surfaces of the ribbon shape oriented vertically. In other words, the top and bottom surfaces of the flat cable 85 fall in vertical planes, while a normal to these surfaces is oriented horizontally. Further, the direction in which the flat cable 85 extends from the carriage 38 and the extending direction of the ink tubes 41 are identical to the reciprocating direction of the carriage 38.

The end of the flat cable 85 fixed to the carriage 38 is electrically connected to the head control circuit board mounted in the carriage 38. The other end of the flat cable 85 fixed to the fixing clip 86 extends to and is electrically connected to the main circuit board. The section of the flat cable 85 curved in a U shape is not fixed to any member, but changes in shape as the carriage 38 reciprocates, similar to the ink tubes 41. A rotating support member 90 is provided for supporting the ink tubes 41 and flat cable 85 as these components change in shape when the carriage 38 reciprocates. The rotating support member 100 supports the ink tubes 41 and the flat cable 85.

A restricting wall 37 is provided on the front surface of the printer section 2 extending in the width direction (left-to-right direction). The restricting wall 37 has a vertical surface that is contacted by the ink tubes 41 and extends along a straight line following the reciprocating direction of the carriage 38. The restricting wall 37 is disposed in the area that the ink tubes 41 extend from the fixing clip 36 and is set to a height sufficient for all four ink tubes 41 juxtaposed vertically to contact. The ink tubes 41 extend from the fixing clip 36 along the restricting wall 37.

By contacting the inside surface of the restricting wall 37, the ink tubes 41 are restricted from expanding in a direction toward the front surface of the printer section 2, that is, away from the carriage 38. A section of the ink tubes 41 from the fixing clip 36 to the curved section is maintained in a vertically juxtaposed relationship at the fixing clip 36 with the ink tubes 41 contacting the restricting wall 37. Therefore, the ink tubes 41 are reliably maintained in a desired sloping arrangement within the U-shaped curved section.

The fixing clip 36 is disposed near the widthwise center of the printer section 2. The fixing clip 36 fixes the ink tubes 41 so that the ink tubes 41 extend toward the restricting wall 37. More specifically, the vertical surface of the restricting wall 37 and the direction in which the ink tubes 41 extend from the fixing clip 36 forms an obtuse angle less than 180 degrees in a plan view. The ink tubes 41 are flexible, but have a degree of stiffness (flexural rigidity). Hence, the ink tubes 41 press against the surface of the restricting wall 37 when extending at the angle from the fixing clip 36 to the restricting wall 37. Consequently, the range in which the ink tubes 41 follow the restricting wall 37 expands within the reciprocating range of the carriage 38, thereby reducing the area in the section from the curved section of the ink tubes 41 to the carriage 38 that expands toward the carriage 38.

The fixing clip 86 is disposed near the widthwise center of the printer section 2 further inside than the fixing clip 36. The fixing clip 86 fixes the flat cable 85 so that the flat cable 85 expands toward the restricting wall 37. Hence, the vertical surface of the restricting wall 37 and the direction in which the flat cable 85 extends from the fixing clip 86 forms an obtuse angle smaller than 180 degrees in a plan view. The flat cable 85 is flexible, but has a degree of stiffness (flexural rigidity). Hence, the flat cable 85 presses against the surface of the restricting wall 37 when extending at the angle from the fixing clip 86 to the restricting wall 37. Consequently, the range in which the flat cable 85 follows the restricting wall 37 expands within the reciprocating range of the carriage 38, thereby reducing the area in the section from the curved section of the flat cable 85 to the carriage 38 that expands toward the carriage 38.

As shown in FIGS. 5 and 7, a pair of conveying rollers 89 is disposed upstream of the image-recording unit 24 in the conveying direction. The conveying rollers 89 include a drive roller 87, and a pinch roller 88 that contacts the drive roller 87 with pressure from the bottom thereof. The conveying rollers 89 register a sheet of recording paper conveyed along the paper-conveying path 23 and inserted into a nip point between the drive roller 87 and pinch roller 88. The conveying rollers 89 also pinch the recording paper and convey the paper over the platen 42 after performing the registration process for a prescribed time period.

Figure 18:
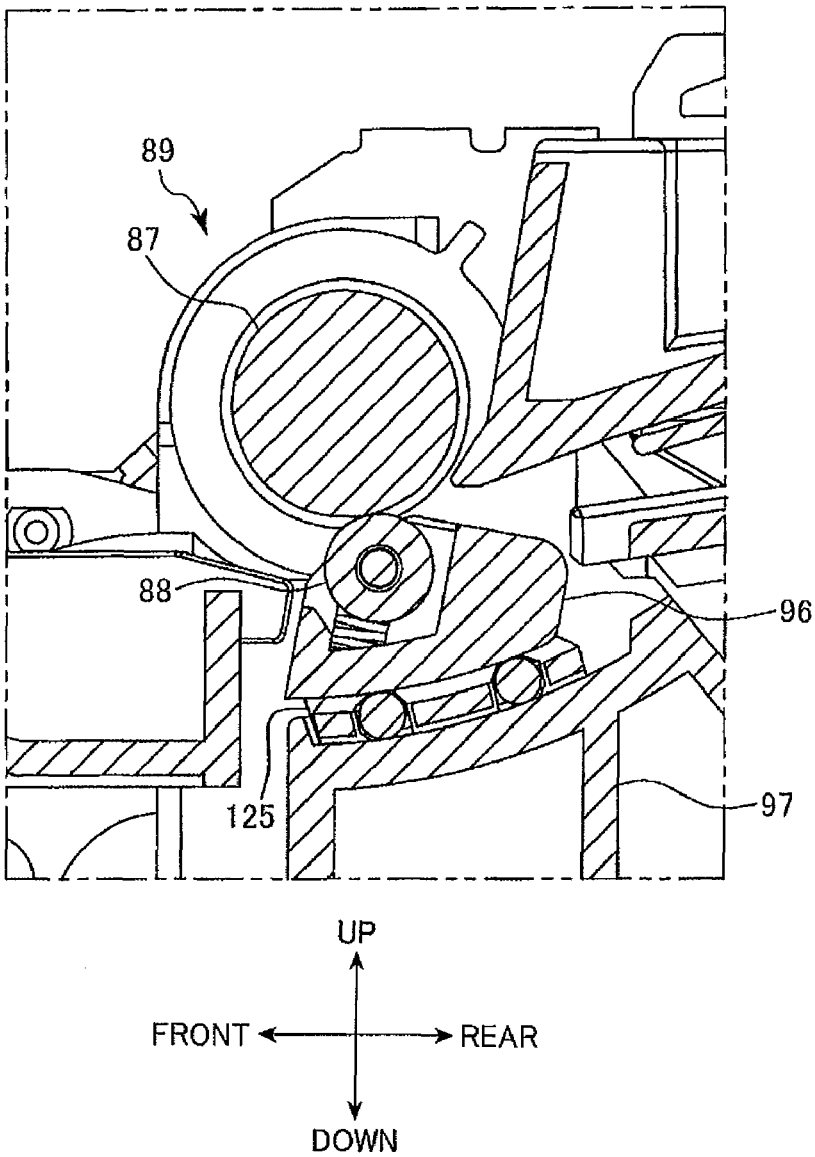
FIG. 18 is the cross-sectional view showing the pinch roller holder in a conveying position.

The pinch roller 88 is rotatably supported in a pinch roller holder 96 while contacting the drive roller 87 with a prescribed urging force. The pinch roller holder 96 is rollingly supported on a holder support member 97 (FIG. 5) so as to be capable of rolling in the paper-conveying direction. The holder support member 97 is integrally provided with an internal frame 95 (see FIG. 5) forming the casing of the multifunction device 1. When the conveying rollers 89 begin conveying recording paper with this support structure, the pinch roller holder 96 rollingly shifts downstream in the paper-conveying direction to a conveying position shown in FIG. 18 and is maintained in this position while conveying the recording paper. When the trailing edge of the recording paper leaves the conveying rollers 89, the pinch roller holder 96 immediately rollingly shifts upstream in the paper-conveying direction to a retracted position. The structures of the holder support member 97 and pinch roller holder 96, as well as a support structure for supporting the holder support member 97 and pinch roller holder 96, will be described in greater detail below.

As shown in FIG. 5, a pair of discharge rollers 92 is disposed downstream of the image-recording unit 24 in the paper-conveying direction. The discharge rollers 92 include a drive roller 90, and a spur roller 91 disposed above the drive roller 90. The drive roller 90 and spur roller 91 pinch and convey recording paper to the discharge tray 21 after the recording operation. Since the drive roller 90 and spur roller 91 press against recording paper that has been printed, the surface of the spur roller 91 is formed irregularly so as not to degrade the image recorded on the paper. The spur roller 91 is movably disposed and can be slid in a direction toward and away from the drive roller 90 A coil spring (not shown) urges the spur roller 91 to contact the drive roller 90 with pressure. When recording paper approaches the nip part between the drive roller 90 and spur roller 91, the spur roller 91 recedes against the urging force of the spring by a distance equivalent to the thickness of the recording paper so that the recording paper is interposed between the drive roller 90 and spur roller 91 and pressed against the drive roller 90. Accordingly, the rotating force of the drive roller 90 is reliably transmitted to the recording paper.

Figure 8:
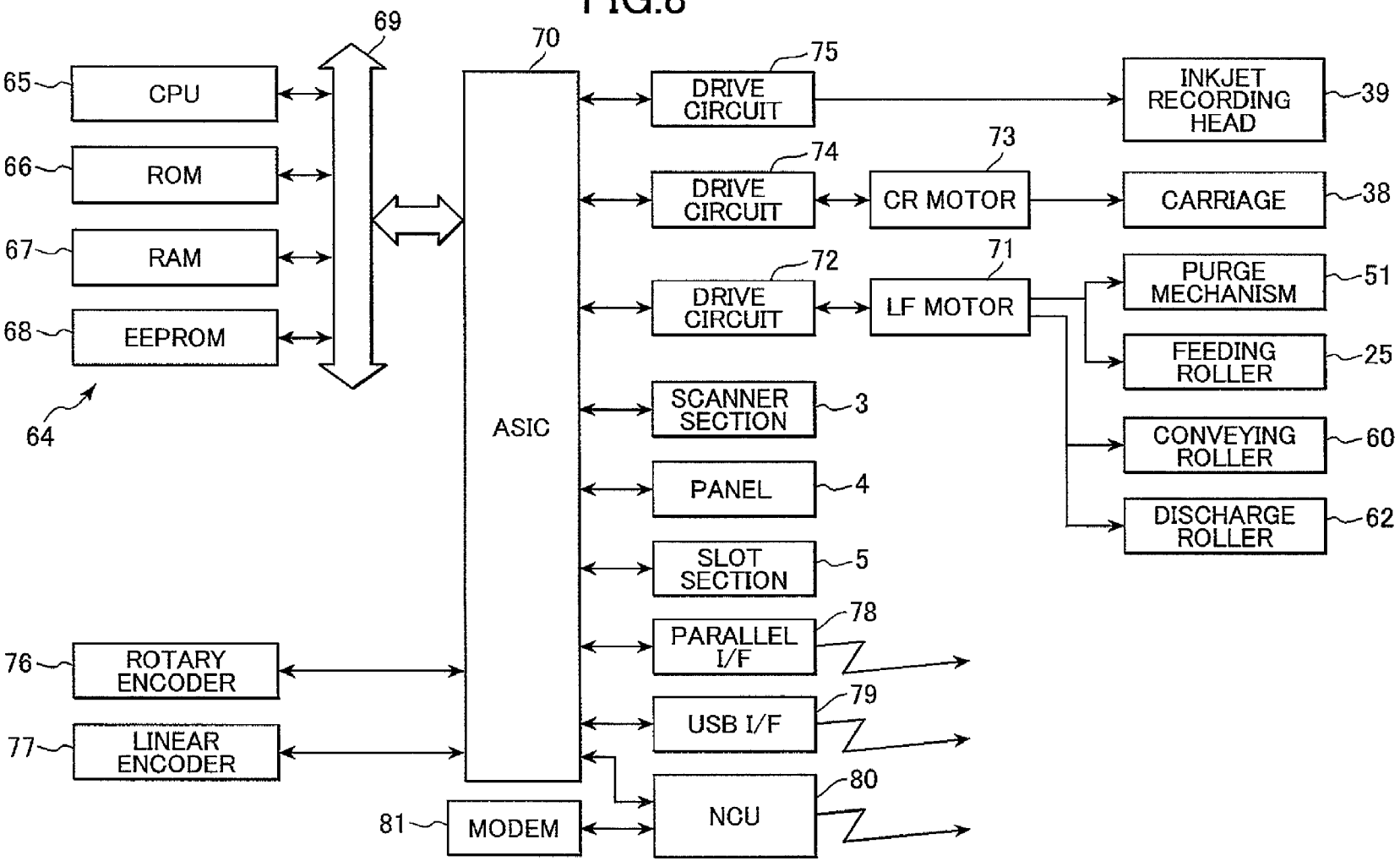
FIG. 8 is a block diagram showing the structure of a controller in the multifunction device.

The drive roller 87 and drive roller 90 are driven to rotate by a drive force transmitted from the linefeed motor 71 (see FIG. 8). The linefeed motor 71 is coupled to an axial end of the drive roller 87. When a sheet of recording paper fed from the feeding tray 20 approaches the nip part between the drive roller 87 and pinch roller 88, the drive roller 87 is driven in a reverse rotation for returning the recording paper upstream in the paper-conveying direction, and the pinch roller 88 follows the rotation of the drive roller 87. This reverse rotation functions to register the leading edge of the recording paper that has arrived at the nip part in order to correct skew in the paper. This registration process can also be achieved by halting the drive roller 87 rather than rotating the drive roller 87 in reverse.

After the registration process has been performed for a prescribed time, the drive roller 87 is driven in a forward rotation for conveying the recording paper downstream. Consequently, the recording paper is pinched by the drive roller 87 and pinch roller 88 and conveyed downstream. Rotation of the drive roller 87 and drive roller 90 is synchronized. Further, a rotary encoder 76 (see FIG. 8) is provided on the drive roller 87. The rotary encoder 76 has an optical sensor 94 for detecting a pattern on an encoder disk 93 (see FIG. 7) rotating together with the drive roller 87. The controller 64 (see FIG. 8) controls rotation of the drive roller 87 and drive roller 90 based on detection signals from the rotary encoder 76.

The drive roller 87 is driven intermittently at prescribed linefeed widths Accordingly, recording paper pinched by the drive roller 87 and pinch roller 88 is conveyed intermittently over the platen 42 at the prescribed linefeed widths. The inkjet recording head 39 is scanned after each linefeed and records an image beginning from the leading edge side of the recording paper. The drive roller 90 and spur roller 91 pinch the leading edge side of the recording paper after an image has been recorded thereon. Hence, the recording paper is conveyed intermittently at prescribed linefeed widths, with the leading edge side of the paper pinched between the drive roller 90 and spur roller 91 and with the trailing edge side pinched between the drive roller 87 and pinch roller 88, while the inkjet recording head 39 records an image after each linefeed. As the recording paper is conveyed further, the trailing edge of the paper separates from the drive roller 87 and pinch roller 88 so that the conveying rollers 89 no longer grip the paper. At this time, the recording paper is conveyed intermittently at the prescribed linefeed widths while gripped only by the drive roller 90 and spur roller 91, and the inkjet recording head 39 continues to record an image after each linefeed. After an image has been completed in the prescribed region of the recording paper, the drive roller 90 is driven to rotate continuously, and the paper gripped by the drive roller 90 and spur roller 91 is discharged onto the discharge tray 21.

FIG. 8 is a block diagram showing the structure of the controller 64 in the multifunction device 1. The controller 64 controls the overall operations of the multifunction device 1, including not only the scanner section 3, but also the printer section 2. The controller 64 is configured of a main circuit board connected to the flat cable 85. Since the structure of the scanner section 3 is not important in the invention, a detailed description of this structure has been omitted. As shown in FIG. 8, the controller 64 is configured of a microcomputer primarily including a CPU 65 (central processing unit), a ROM (read-only memory) 66, a RAM (random access memory) 67, and a EEPROM (electrically erasable and programmable ROM) 68. These components are connected to an ASIC (application specific integrated circuit) 70 via a bus 69.

The ROM 66 stores programs for controlling various operations of the multifunction device 1. The RAM 67 functions as a storage area or a work area for temporarily saving various data used by the CPU 65 in executing the programs. The EEPROM 68 stores settings, flags, that must be preserved when the power is turned off.

As shown in FIG. 8, on a command from the CPU 65, the ASIC 70 generates a phase excitation signal for conducting electricity to the linefeed motor 71. The signal is applied to a drive circuit 72 of the linefeed motor 71. By supplying a drive signal to the linefeed motor 71 via the drive circuit 72, the ASIC 70 can control the rotation of the linefeed motor 71.

The drive circuit 72 drives the linefeed motor 71, which is connected to the feeding roller 25, and purge mechanism 51. Upon receiving an output signal from the ASIC 70, the drive circuit 72 generates an electric signal for rotating the linefeed motor 71. When the linefeed motor 71 rotates, the rotational force of the linefeed motor 71 is transferred to the feeding roller 25, conveying roller 60, discharge rollers 62, and purge mechanism 51 via a drive mechanism well known in the art that includes gears, drive shafts. In other words, in addition to feeding recording paper from the feeding tray 20, the linefeed motor 71 in the multifunction device 1 functions to convey recording paper to a position over the platen 42 and to discharge recording paper onto the discharge tray 21 after recording is completed.

Similarly, upon receiving a command from the CPU 65, the ASIC 70 generates a phase excitation signal and the like for supplying electricity to the carriage motor 73 and applies this signal to a drive circuit 74 of the carriage motor 73. By supplying a drive signal to the carriage motor 73 via the drive circuit 74, the ASIC 70 can control the rotation of the carriage motor 73.

The drive circuit 74 functions to drive the carriage motor 73. Upon receiving an output signal from the ASIC 70, the drive circuit 74 generates an electric signal for rotating the carriage motor 73. When the carriage motor 73 rotates, the rotational force of the carriage motor 73 is transferred to the carriage 38 via the belt drive mechanism 46, thereby scanning the carriage 38 in a reciprocating motion. In this way, the controller 64 can control the reciprocation of the carriage 38.

A drive circuit 75 is provided for driving the inkjet recording head 39 at a prescribed timing. The ASIC 70 generates and outputs a signal to the drive circuit 75 based on a drive control procedure received from the CPU 65, The drive circuit 75 drives the inkjet recording head 39 based on the output signal received from the ASIC 70. The drive circuit 75 is mounted in the head control circuit board. When an output signal is transferred from the main circuit board constituting the controller 64 to the head control circuit board via the flat cable 85, the drive circuit 75 drives the inkjet recording head 39 to selectively eject ink of each color onto the recording paper at a prescribed timing.

The ASIC 70 is also connected to the rotary encoder 76 for detecting the rotated amount of the conveying roller 60, the linear encoder 77 for detecting the position of the carriage 38. When the power of the multifunction device 1 is turned on, the carriage 38 is moved to one end of the guide rails 43 and 44 and the detection position of the linear encoder 77 is initialized. When the carriage 38 moves from this initial position over the guide rails 43 and 44, the optical sensor 35 provided on the carriage 38 detects the pattern on the encoder strip 50 and outputs a pulse signal based on these detections. The controller 64 determines the distance that the carriage 38 has moved based on the number of pulse signals. According to this detected movement, the controller 64 controls the rotation of the carriage motor 73 in order to control the reciprocating motion of the carriage 38.

The ASIC 70 is also connected to the scanner section 3; the control panel 4 for specifying operations of the multifunction device 1; the slot section 5 in which various small memory cards can be inserted; a parallel interface 78, and a USB interface 79 fox exchanging data with a personal computer or other external device via a parallel cable or USB cable; and a NCU (network control unit) 80 and a modem 81 for implementing a facsimile function.

Next, the structure of the holder support member 97 and the pinch roller holder 96, and the support structure of the pinch roller holder 96 will be described in detail with reference to FIGS. 9 through 18. FIGS. 12-18 are cross-sectional diagrams taken along a plane perpendicular to the rotational axis of the drive roller 87. In the following explanation, points (O, A, B, B1, B2, G0, G1, G2) and lines (L1, L2) shown in FIGS. 12-18 are disposed on this plane.

Figure 9:
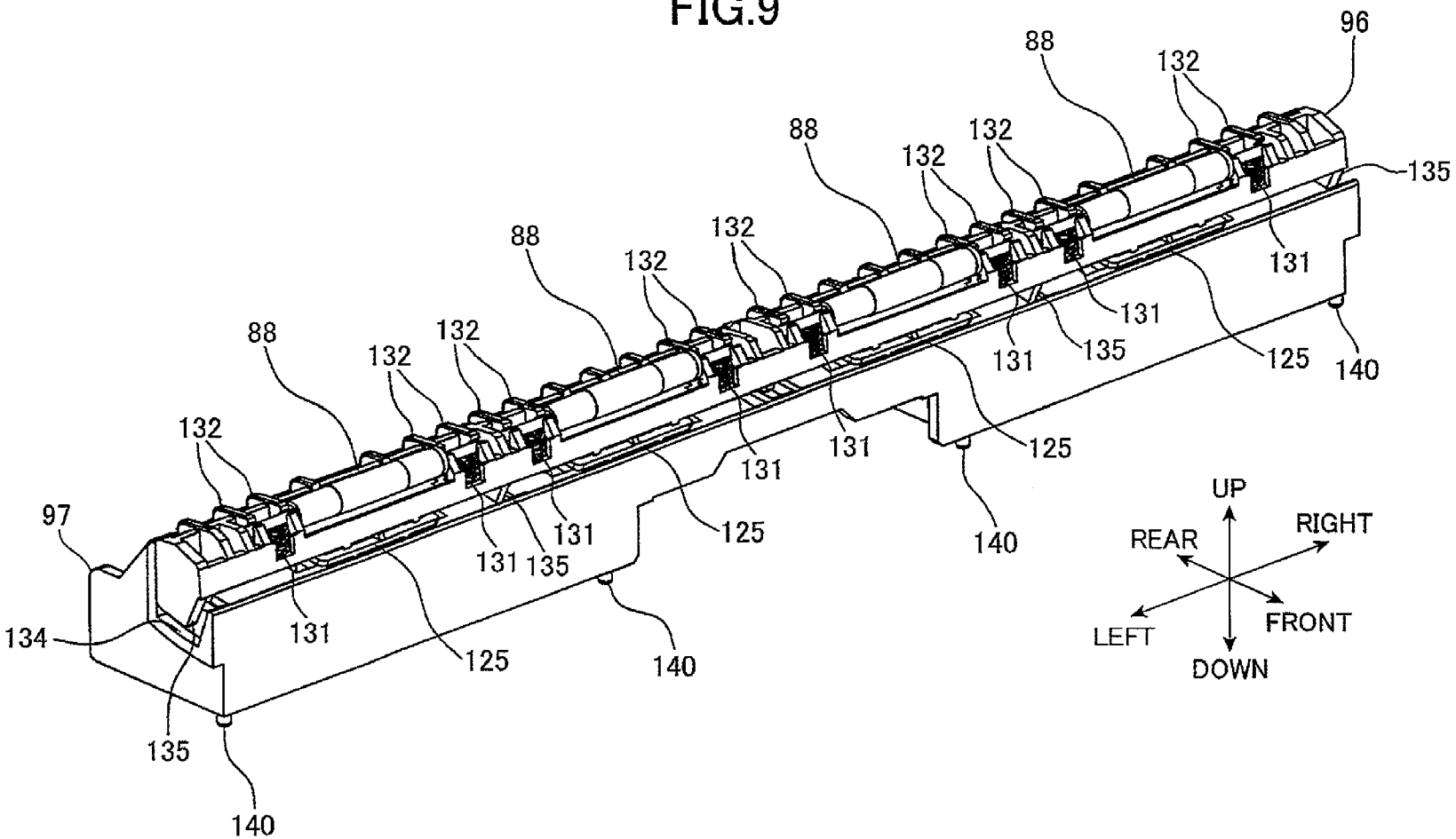
FIG. 9 is a perspective view of a pinch roller holder supported on a holder support member.
Figure 10:
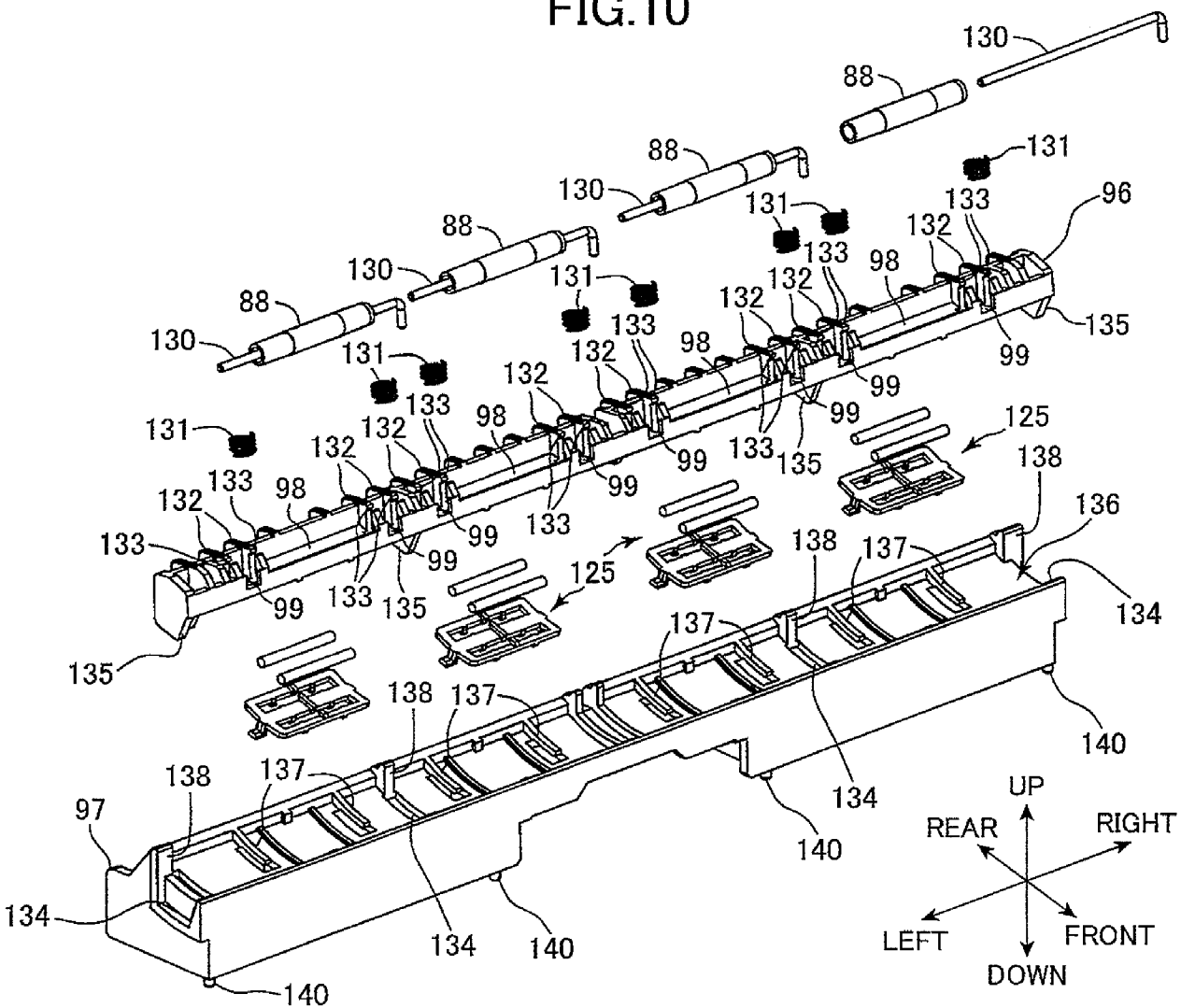
FIG. 10 is an exploded view of the holder support member and the pinch roller holder.

The pinch roller holder 96 has an elongated shape, as shown in FIGS. 9 and 10 and extends longitudinally along the width direction of the recording paper. As shown in FIG. 10, four roller-accommodating compartments 98 and eight spring-accommodating compartments 99 are provided on the top surface of the pinch roller holder 96 opposing the drive roller 87. The roller-accommodating compartments 98 are formed at prescribed intervals along the longitudinal direction of the pinch roller holder 96. Four protruding pieces 135 are formed on the bottom surface of the pinch roller holder 96.

The pinch rollers 88 are accommodated in the spring-accommodating compartments 99 and have rotational shafts 130 aligned with the longitudinal direction of the pinch roller holder 96. The spring-accommodating compartments 99 are formed adjacent to and on both ends of the roller-accommodating compartments 98. Coil springs 131 are accommodated in the spring-accommodating compartments 99 in a compressed state. This construction is one example, but it should be apparent that the number of the pinch rollers 88 and coil springs 131 and the accommodating method may be modified as appropriate.

The spring-accommodating compartments 99 are defined by partitioning plates 132 erected on both longitudinal sides of the spring-accommodating compartments 99. A bearing 133 is formed in each partitioning plate 132 for supporting the rotational shaft 130 of the respective pinch roller 88. The bearings 133 are formed as long vertical grooves in the opposing partitioning plates 132. The upper end of the groove constituting the bearings 133 is formed slightly smaller than the diameter of the rotational shaft 130. When the rotational shaft 130 is pressed into the bearings 133, the upper end of the groove widens elastically to allow insertion of the rotational shaft 130. After the rotational shaft 130 is completely inserted, the upper ends of the grooves are restored to their original shape so that the rotational shaft 130 cannot easily come out of the bearings 133. In this way, the rotational shaft 130 is supported in the bearings 133, while being capable of moving vertically within the grooves. By extension, the pinch rollers 88 are supported so as to be capable of moving vertically along the depth direction of the bearings 133.

The spring-accommodating compartments 99 are formed as recessed parts that are recessed in the depth direction of the bearings 133 formed in the partitioning plates 132. The coil springs 131 are housed in the spring-accommodating compartments 99, and the rotational shafts 130 of the pinch rollers 88 are inserted into the bearings 133, compressing the coil springs 131. As a result, the elastic force of the compressed coil springs 131 urges the pinch rollers 88 upward, in other words, an urging force toward the drive roller 87 is applied to the pinch rollers 88. Hence, the pinch rollers 88 are rotatably supported in the bearings 133 and urged toward the drive roller 87 by the coil springs 131. When recording paper of a prescribed thickness is conveyed to the drive roller 87 and pinch rollers 88, the paper pushes the pinch rollers 88 downward against the urging force of the coil springs 131 by a distance corresponding to the paper thickness.

As described above, the spring-accommodating compartments 99 are formed as recessions that are recessed in the depth direction of the bearings 133. Therefore, the expanding and contracting direction of the coil spring 131 matches the direction in which the pinch rollers 88 move up and down. Accordingly, the entire urging force of the coil springs 131 is applied to the pinch rollers 88 for pressing the pinch rollers 88 against the drive roller 87. Of course the expanding/contracting direction of the coil spring 131 need not match the moving direction of the pinch rollers 88, provided the structure applies a pressure force toward the drive roller 87 to the pinch rollers 88. Here, the coil spring 131 may be configured of a plate spring or other type of spring. It is also possible to use another type of urging means for applying a pressure force to the pinch roller 88, such as an elastic member formed of rubber.

The protruding pieces 135 engage in engaging grooves 134 formed in the holder support member 97. The protruding pieces 135 are plate-shaped members that protrude downward from the bottom surface of the pinch roller holder 96 and extend along the shorter dimension of the pinch roller holder 96. The protruding pieces 135 fit into the engaging grooves 134 with a prescribed degree of play. With this construction, the holder support member 97 supports the pinch roller holder 96 so that the pinch roller holder 96 can move along the shorter direction of the holder support member 97, that is, the paper-conveying direction, while restricting the movement of the pinch roller holder 96 to a prescribed range.

The holder support member 97 has an elongated shape similar to the pinch roller holder 96 and is arranged on the internal frame 95 (see FIG. 5) so the longitudinal dimension is aligned with the width direction of the recording paper. More specifically, protrusions 140 are formed on the bottom surface of the holder support member 97. The holder support member 97 is fixed to the internal frame 95 in the position shown in FIG. 5 by fitting the protrusions 140 into holes (not shown) formed in the internal frame 95. A curved surface 136 (see FIG. 12) is formed on the top surface of the holder support member 97. The curved surface 136 supports the bottom surface of the pinch roller holder 96 via rolling bearings 125.

Figure 12:
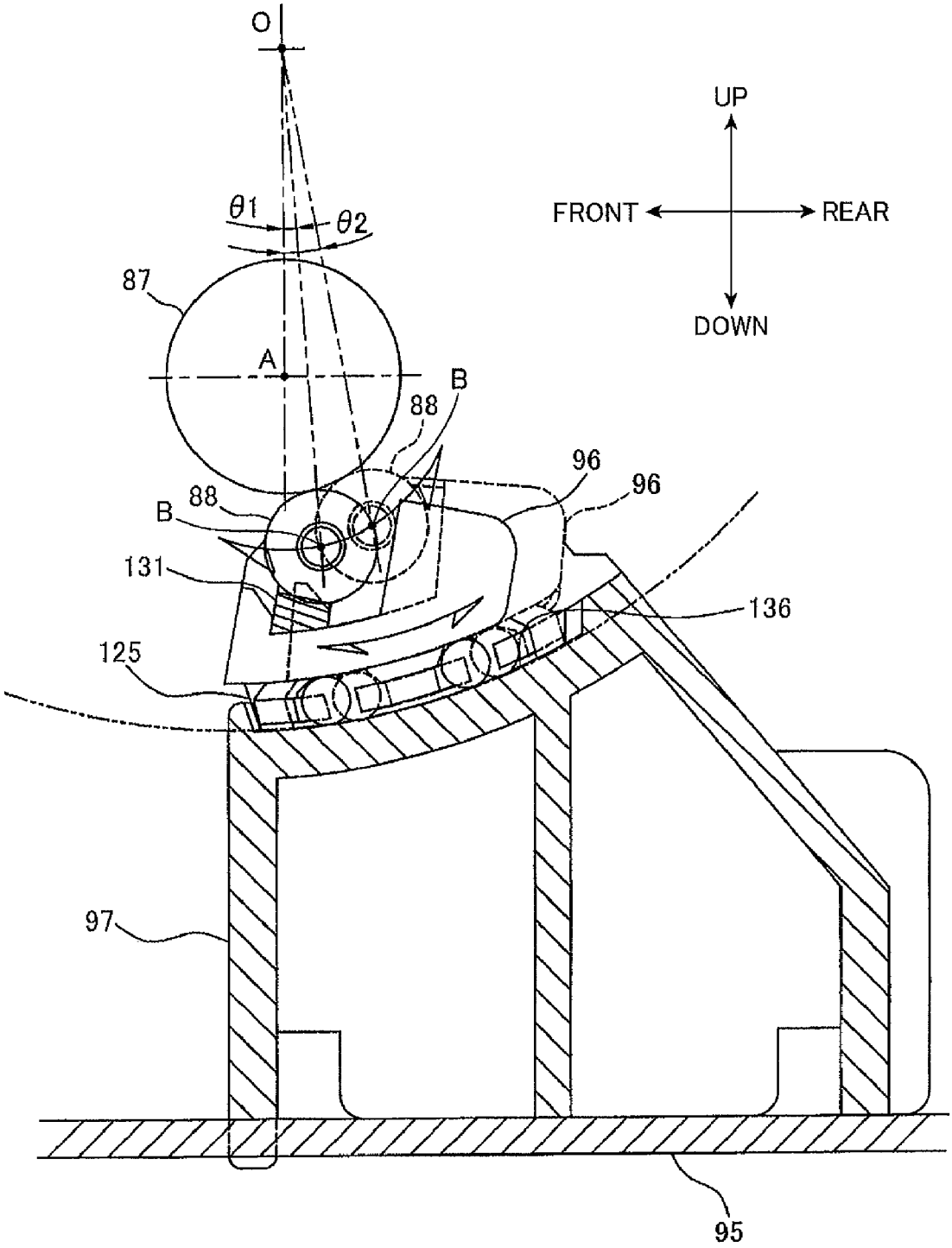
FIG. 12 is an enlarged view illustrating the moving range of the pinch roller holder.

As shown in FIG. 10, four engaging grooves 134 and four engagement parts 137 are formed in the curved surface 136. As shown in FIG. 12, the curved surface 136 of the holder support member 97 slopes downward from the upstream side to the downstream side in the paper-conveying direction. The curved surface 136 has an arc shape that substantially conforms to the outer periphery of a cylindrical path about an axis of revolution passing through a point O shown in FIG. 12 (hereinafter referred to as the "center of revolution O"). The axis of revolution is set parallel to and vertically above a rotational axis of the drive roller 87 (an axis through point A in FIG. 12). Hence, the rotational axis of the drive roller 87 and the axis of revolution fall within the same vertical plane. The four engaging grooves 134 are formed for engaging with the protruding pieces 135 described above. The engaging grooves 134 are formed sufficiently longer in the short dimension of the pinch roller holder 96 than the extended length of the protruding pieces 135 in the same direction.

Figure 11:
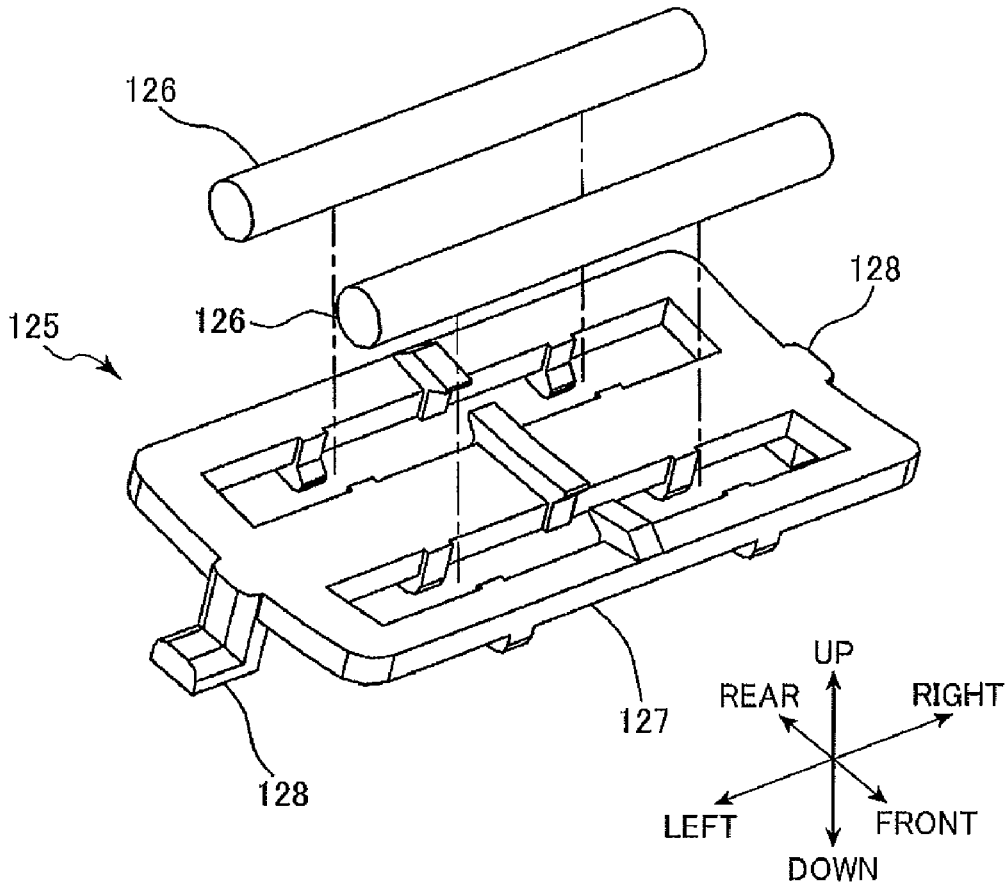
FIG. 11 is a perspective view showing the structure of a roller bearing.

As shown in FIGS. 10 and 11, each of the rolling bearings 125 is configured of two rollers 126 juxtaposed in parallel along the short dimension of the holder support member 97, and a roller support member 127 for rotatably supporting the two rollers 126 together. The roller support member 127 is mounted on the curved surface 136 of the holder support member 97 with the rollers 126 supported therein. Specifically, engaging pawls 128 having an L-shaped cross-section are formed one on each longitudinal end of the roller support member 127. The roller support member 127 is mounted on the holder support member 97 by engaging the engaging pawls 128 in one of the four sets of engagement parts 137 (see FIG. 10) formed in the curved surface 136. As shown in FIG. 10, four of the rolling bearings 125 are mounted at prescribed intervals along the longitudinal direction of the holder support member 97. By interposing the rolling bearings 125 having this structure between the pinch roller holder 96 and the curved surface 136 of the holder support member 97, the pinch roller holder 96 can be rollingly supported on the curved surface 136. However, while the multifunction device 1 gives one example of using the rolling bearings 125 as a support structure for rollingly supporting the pinch roller holder 96, it is possible to employ another structure that integrally provides rotary members that are freely rotatable on the curved surface 136 of the holder support member 97 or the bottom surface of the pinch roller holder 96. For example, it is conceivable to incorporate rolling bearings or ball bearings well known in the art in the curved surface 136 or the bottom surface of the pinch roller holder 96.

Ribs 138 extending upward from the curved surface 136 of the holder support member 97 are formed on the rear ends of the engaging grooves 134, continuing upward from the inner wall and rear side of the engaging grooves 134. The ribs 138 function to restrict rearward movement of the pinch roller holder 96. When the pinch roller holder 96 is supported on the holder support member 97 so as to be capable of moving in the short dimension of the holder support member 97 while the protruding pieces 135 are engaged with the engaging grooves 134, forward movement of the pinch roller holder 96 is restricted when the front ends of the protruding pieces 135 contact the inner wall on the front sides of the engaging grooves 134, and rearward movement of the pinch roller holder 96 is restricted when the rear ends of the protruding piece 135 contact the ribs 138.

As shown in FIG. 12, the pinch roller holder 96 moves about the axis passing through the center of revolution O by rolling over the curved surface 136. Since the coil springs 131 urge the pinch rollers 88 at this time, the pinch rollers 88 move along the peripheral surface of the drive roller 87 while maintaining constant pressure against the drive roller 87. The center of revolution O should be positioned so that the distance separating the center of revolution O and the curved surface 136 is greater than the distance separating a point B at the rotational center of the pinch rollers 88 and the curved surface 136.

In this example, the movable range of the pinch roller holder 96 in the short dimension of the holder support member 97 (front-to-rear direction) is restricted between a conveying position and a retracted position. As shown in FIG. 12, the conveying position is the position of the pinch roller holder 96 at which a line O-B connecting the center of revolution O and the rotational center B of the pinch roller 88 forms an angle $\theta 1$ ($\theta 1>0$) with a vertical line O-A passing through the center of revolution O and the rotational center A of the drive roller 87 toward the rear side of the drive roller 87 (upstream in the paper-conveying direction; indicated by a solid line in FIG. 12; see also FIG. 18). The retracted position is the position of the pinch roller holder 96 in which the line O-B forms an angle $\theta 2$ ($\theta 2>\theta 1$) with the vertical line O-A (indicated by a dotted line in FIG. 12; see also FIG. 16). In other words, movement of the pinch roller holder 96 in a cross-sectional view is restricted to an angle $\theta$ ($\theta 1 \leqq \theta \leqq \theta 2$)

formed by a line segment OA connecting center of revolution O and the rotational center A and the line segment OB connecting the center of revolution O and the rotational center B.

With this configuration of the pinch roller holder 96 and holder support member 97, the pinch roller holder 96 moves from the retracted position (see FIG. 17) to the conveying position (see FIG. 17) when the conveying rollers 89 begin pinching and conveying the leading edge of recording paper. The pinch roller holder 96 remains in the conveying position while the recording paper is conveyed. When the trailing edge of the recording paper leaves the conveying rollers 89, the pinch roller holder 96 moves to the retracted position and is maintained in the retracted position as the recording paper is discharged.

Figure 13:
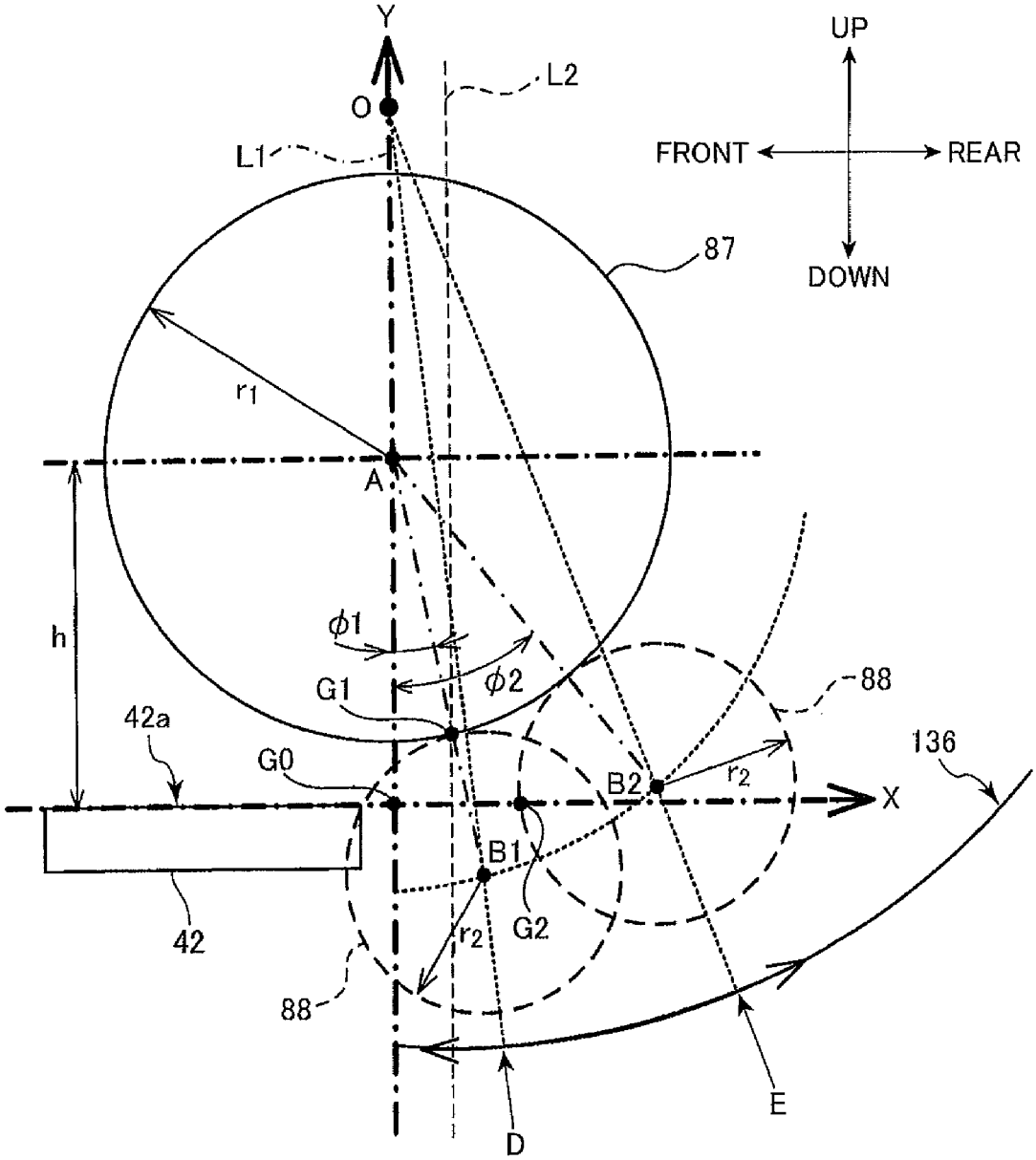
FIG. 13 is a cross-sectional view of conveying rollers in the multifunction device showing the positional relationship of a drive roller and a pinch roller.
Figure 14B:
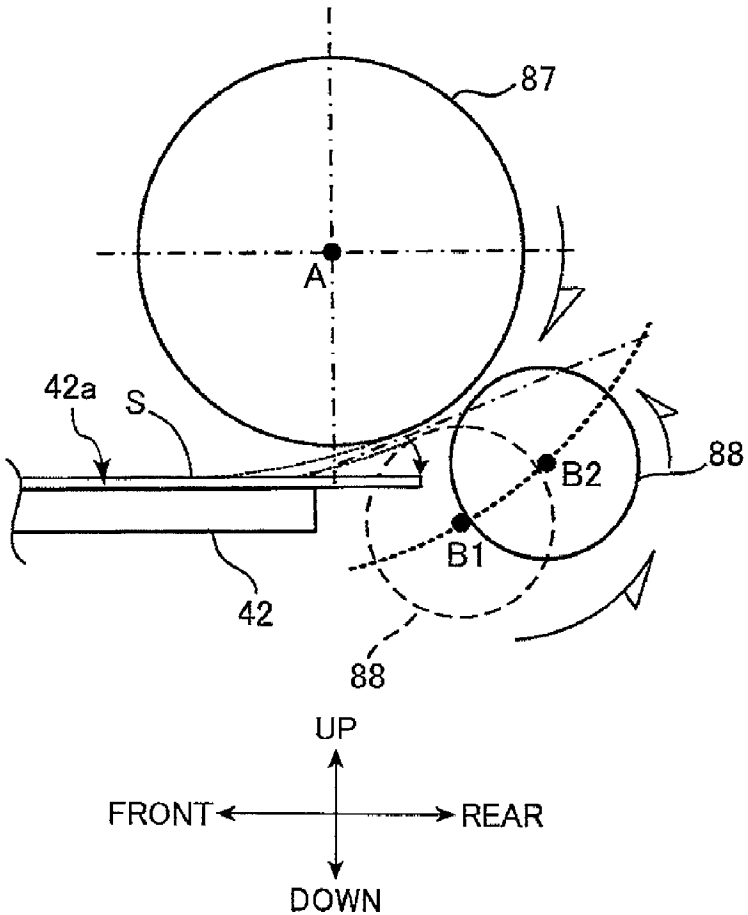
FIG. 14(*a*) is a cross-sectional view of the conveying rollers in the multifunction device when the trailing edge of the recording paper is in contact with the surface of the conveying rollers.
Figure 14A:
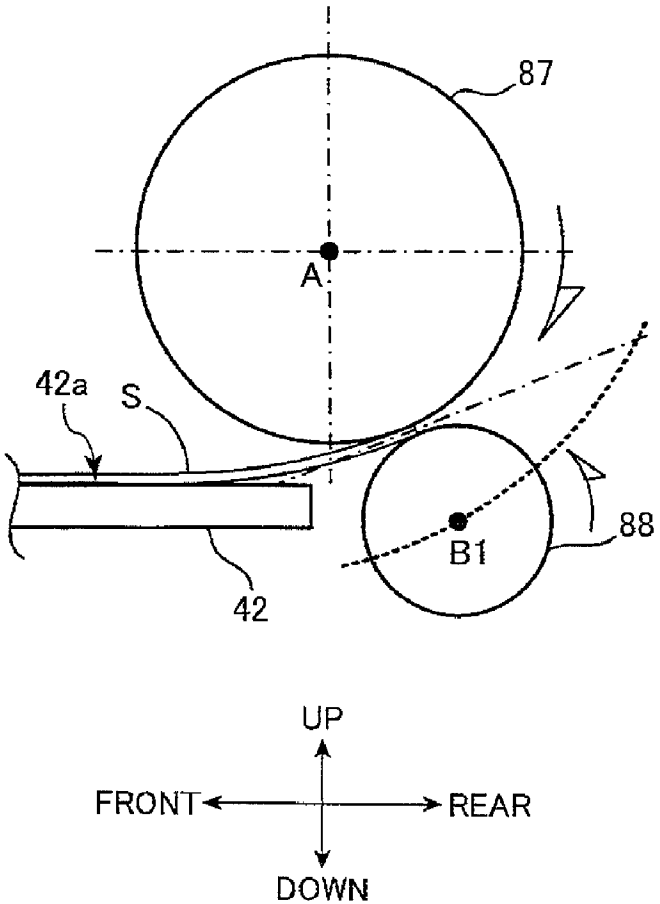

As shown in FIGS. 12 and 13, the rotational shaft of the pinch roller 96 is set upstream of the vertical plane passing through the rotational shaft of the drive roller 87 when the pinch roller holder 96 is in the conveying position. Further, the roller surface of the pinch roller 88 does not intersect a vertical line passing through a contact point G1 (see FIG. 13) when the pinch roller holder 96 is in the conveying position. Where the contact point G1 is defined by a nip point between the drive roller 87 and the pinch roller 88 when the pinch roller holder 96 is in the conveying position. In other words, in the cross-sectional view shown in FIG. 13, the conveying position is set so that the rotational center B of the pinch roller 88 is positioned farther upstream than a vertical line L1 passing through the rotational center A of the drive roller 87 (or the line segment OA), and the retracted position is set so that the roller surface of the pinch roller 88 does not intersect a vertical line L2 passing through the contact point G1. By setting these positional relationships, the pinch roller 88 is immediately retracted to the position shown in FIG. 14(*b*) when the trailing edge of the recording paper S leaves the conveying rollers 89 from the pinched state shown in FIG. 14(*a*). Almost simultaneously the recording paper S is restored to its original flat shape on the sheet support surface 42*a* of the platen 42, without the trailing edge of the recording paper S being supported on the roller surface of the pinch roller 88.

Next, the relationship between the conveying position and the retracted position will be described in detail with reference to FIG. 13. FIG. 13 is a cross-sectional view of the conveying rollers 89 illustrating the positional relationship of the drive roller 87 and pinch roller 88 in an XY coordinate system based on the point of origin G0, where G0 is the intersecting point between a vertical plane passing through the point A and the supporting surface 42*a* of the platen 42. In FIG. 13, D indicates the conveying position, and E indicates the retracted position. B1 and B2 indicate the rotational axis of the pinch rollers 88 when the pinch roller 88 is in the conveying position E and retracted position D, respectively. The pinch roller 88 is depicted with a dotted line, when the pinch roller holder 96 is in the conveying position D and the retracted position E. Here, the X coordinate of a nip point G1 (x(G1)) between the pinch rollers 88 and drive roller 87 when the pinch roller holder 96 is in the conveying position D and the X coordinate of an intersecting point G2 (x(G2)) between the roller surface of the pinch roller 88 and the supporting surface 42*a* when the pinch roller holder 96 is in the retracted position E can be derived from the following equations (1) and (2).

$$x(G1)=r1\sin\phi1 \quad (1)$$

$$x(G2)=\sqrt{r1^2-\{(r1+r2)\cos\phi2-h\}^2}-(r1+r2)\sin\phi2 \quad (2)$$

Here, $\phi1$ denotes an angle between the line O-A and the line O-B1 passing through the point O and B1. $\phi2$ denotes an angle between the line O-A and the line O-B2 passing through the point O and B2.

As described above, in order for the vertical line passing through the point A not to intersect the roller surface of the pinch roller 88 when the pinch roller holder 96 is in the retracted position, the intersecting point G2 must be separated from the nip point, G1 in the positive X direction. In other words, the x(G2) must be greater than the x(G1). Hence, if the angle $\phi1$ is set to an arbitrary angle, then the retracted position must be set so that an angle $\phi2$ satisfies the following equation (3).

$$\sqrt{r1^2-\{(r1+r2)\cos\phi2-h\}^2}-(r1+r2)\sin\phi2>r1\sin\phi1 \quad (3)$$

By setting the angle $\phi2$ to satisfy the equation (3) for the arbitrary set angle $\phi1$, the trailing edge of the recording paper returns to its original flat shape on the supporting surface 42*a* of the platen 42 after leaving the conveying rollers 89, without being supported on the pinch roller 88. Therefore, this configuration prevents the recording paper from floating off the supporting surface 42*a*, and also prevents image distortion on the trailing edge side of the recording paper and ink stains on the paper due to contact with the recording head.

Figure 15:
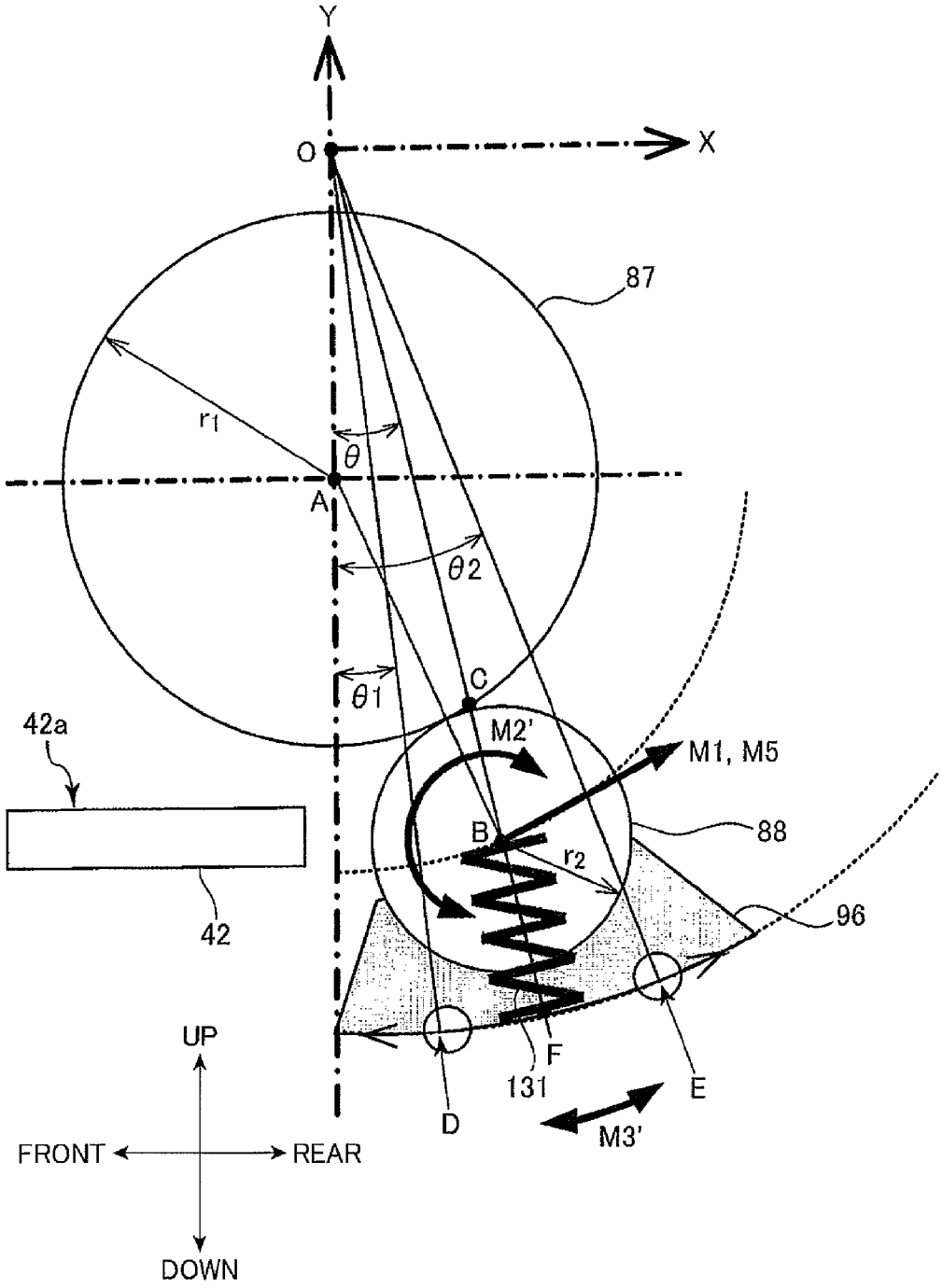
FIG. 15 is a cross-sectional view of the conveying rollers in the multifunction device showing the positional relationship of the drive roller and pinch roller.

Next, the rolling principle of the pinch roller holder 96 will be described with reference to FIGS. 15 and 16. Here, A and B denote the rotational center of the driver roller 87 and the rotational center of the pinch roller 88, respectively. r1 and r2 denote a radius of the drive roller 87 and a radius of the pinch roller 88, respectively. The rotational center A is positioned on the Y-axis, with the center of revolution O (point of origin O) at a position separated a distance greater than the radius r1 of the drive roller 87 in the +Y direction from the rotational center A. The point of origin O conforms to the center of an arc following the curved surface 136. The pinch roller holder 96 can move by rolling about the point of origin O between the conveying position D rotated the angle $\theta1$ ($\theta1>0$) from the Y-axis in the counterclockwise direction, and the retracted position E rotated the angle $\theta2$ ($\theta2>\theta1$) from the Y-axis in the same direction. For explanatory purposes, the centers O, A, and B shown in FIGS. 18 and 19 have been defined in the multifunction device 1, but it should be apparent that the center positions of the drive roller 87, pinch roller 88, and a cylindrical path including the curved surface 136 are not limited to these positions.

As described above, an angle formed by line segments OA and OB when the pinch rollers 88 are moved to an arbitrary position is referred to as $\theta$, where the angle $\theta$ may fall within the range $\theta1\leqq\theta\leqq\theta2$. The coil springs 131 accommodated in the pinch roller holder 96 in a compressed state urge the pinch rollers 88 toward the drive roller 87 (along the line segment AB).

As shown in the drawings, the center O of the arc DE does not match the center A of the drive roller 87 about which the pinch roller 88 revolves. Therefore, when $\theta>0$, the pinch roller holder 96 separates from the drive roller 87 as $\theta$ grows larger, forcing the coil springs 131 to expand. Hence, an elastic energy E1 in the coil springs 131 decreases as $\theta$ grows larger. At this time, a moment M1 acts on the pinch rollers 88 in the counterclockwise direction about the center point A, that is, a direction orthogonal to the line segment AB. The magnitude of the moment M1 is proportional to a decrease $dE1/d\theta$ in the elastic energy E1.

At the same time, a frictional force (frictional moment) M2' is produced in the pinch rollers 88 in the direction opposite this rotational direction about the center point B as the pinch rollers 88 follow the rotation of the drive roller 87. Here, M2 will designate the moment found by converting the frictional force M2' to a force about the point A, that is, a direction orthogonal to the line segment AB The frictional force M2' generated at this time is a static frictional force produced on the sliding surfaces of the pinch rollers 88 and rotational shafts 130 as the pinch rollers 88 rotate. The moment M2 is not indicated in FIG. 15.

Further, a rolling frictional force (frictional moment) M3' is generated when the pinch roller holder 96 rolls over the curved surface 136 of the holder support member 97. This rolling frictional force M3' acts about the center of revolution O, that is, in a direction orthogonal to the line segment OB. M3 will be used to designate a moment obtained by converting the frictional force M3' to a force about the point A, that is, in a direction orthogonal to the line segment AB. The moment M3 is not shown in FIG. 15.

Figure 16:
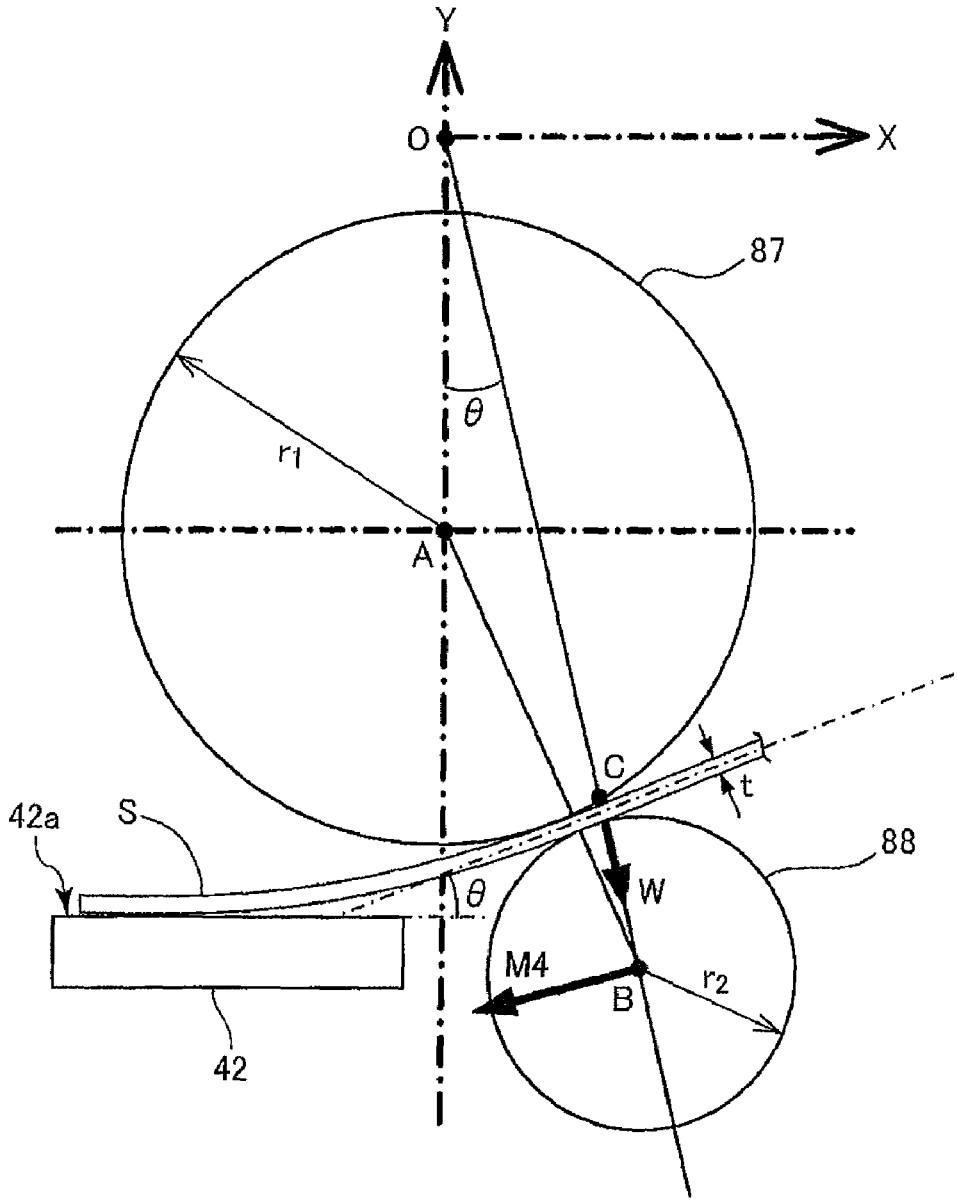
FIG. 16 is a cross-sectional view of the conveying rollers in a conveying position.
Figure 17:
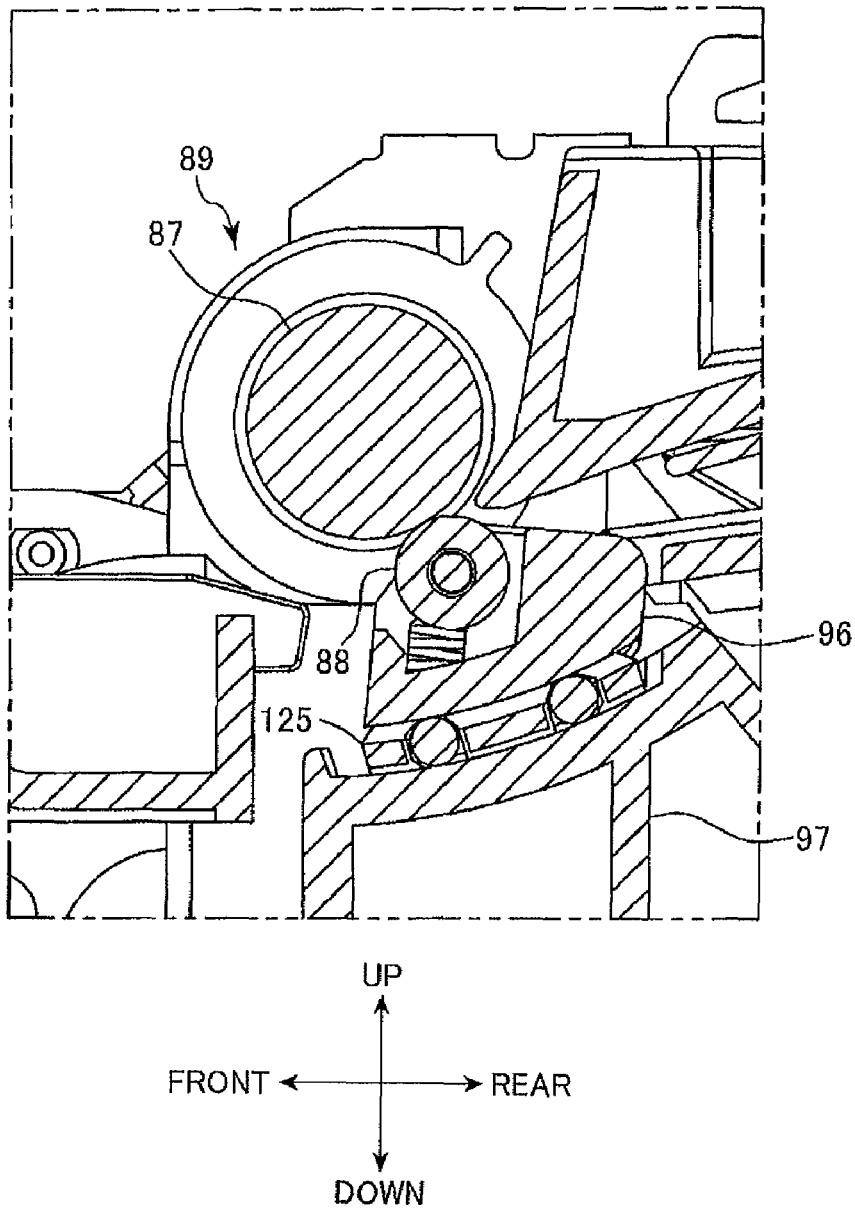
FIG. 17 is a cross-sectional view showing the pinch roller holder in a retracted position.

As shown in FIG. 16, a force W produced by the weight of the recording paper, and an elastic force caused by flexing in the recording paper acts in a direction from the contact point between the recording paper and the pinch roller 88 to the rotational center B of the pinch roller 88 when the drive roller 87 and pinch roller 88 convey the recording paper. This force W generates a moment M4 in a direction where θ grows smaller. As shown in FIG. 19, since the recording paper is conveyed toward the platen 42 at an angle θ above the platen 42 identical to the angle formed by line segments OA and OB, the moment M4 produced by the force W cannot be ignored. In this example, EI signifies the stiffness of the recording paper.

Further, the length of the springs 131 change by the thickness t of the recording paper when the leading edge of the paper arrives at the nip part between the drive roller 87 and pinch roller 88 or when the trailing edge of the recording paper leaves this nip part. Specifically, the coil springs 131 contract by the thickness t in the former case and expand by the thickness t in the latter case. Consequently, the elastic energy of the coil springs 131 also fluctuates at this time, producing a moment M5 about the point A of a magnitude proportional to dE1/dθ, similar to the moment M1 described above.

Since the angle θ (θ1≦θ≦θ2), the thickness t of the recording paper, and the stiffness EI of the recording paper are variables, the moment M1 can be expressed by a function of θ and t, the moment M4 by a function of θ and EI, and the moment M5 as a function of t. While the moments M2 and M3 are also strictly speaking a function of θ and t, these values are much smaller than the moments M1, M4, and M5. Thus, the moment M2 and M3 are considered to be constant. Hereinafter, functions of the angle θ will be expressed as M1(θ) and M4(θ).

In the multifunction device 1, the moments M1-M5 must satisfy the equations described below, assuming that no slippage occurs between the drive roller 87 and pinch roller 88 and that the frictional forces between the drive roller 87 and pinch roller 88 and the pinch roller 88 and the recording paper are sufficiently large.

An equation (4) below is satisfied when the drive roller 87 and pinch roller 88 are not conveying the recording paper. Here, the moment M2 acts in the clockwise direction around the point A, while the moment M3 acts counterclockwise around the point A.

$$M1(\theta)+M3>M2 \tag{4}$$

In this case, the pinch roller holder 96 retracts rearward while rolling upstream in the paper-conveying direction, and is maintained in the retracted position of θθ2.

When the recording paper arrives at the nip part between the drive roller 87 and pinch roller 88 and the leading edge of the recording paper is gripped by the rotating drive roller 87, an equation (5) below is satisfied. At this time, the moment M3 acts counterclockwise around the point A. On the other hand, the moment. M5 acts clockwise around the point A.

$$M1(\theta)+M3<M4(\theta)+M5 \tag{5}$$

At this time, the pinch roller holder 96 rolls downstream in the paper-conveying direction and is maintained in the conveying position of θ=θ1. In other words, the distance between the drive roller 87 and the pinch roller 88 grows larger by the paper thickness t in the case when the pinch roller 88 rotates clockwise around the point A with the movement of the pinch roller holder 96 than the case when the pinch roller 88 does not move, that is, the elastic energy E1 becomes smaller when the pinch roller 88 rotates clockwise.

An equation (6) below is satisfied when the recording paper is being conveyed. At this time, the moment M2 acts clockwise around the point A, while the moment M3 also acts clockwise around the point A.

$$M1(\theta)<M2+M3+M4(\theta) \tag{6}$$

Hence, the pinch roller holder 96 continues to be maintained in the conveying position D of θ=θ1.

When the trailing edge of the recording paper comes out of the nip part between the drive roller 87 and pinch roller 88, a following equation (7) is satisfied. At this time, the moment M3 acts clockwise around the point A, while the moment M5 acts counterclockwise around the point A, as with the moment M1.

$$M1(\theta)+M5>M3 \tag{7}$$

As can be seen from the equation (7), only the moment M3 acts as a frictional force to the moment M1(θ)+M5 produced when the trailing edge of the recording paper leaves the nip part between the drive roller 87 and pinch roller 88. However, since the moment M3 is a very slight frictional force produced by the rolling bearings 125, the moment M3 does not act as a force that pushes the recording paper in the conveying direction. Therefore, nearly all of the moment M1(θ)+M5 acts to rotate the pinch roller holder 96 upstream in the paper-conveying direction. Accordingly, the pinch roller holder 96 is retracted and maintained in the retracted position E of θ=θ2.

A following equation (8) is satisfied when rotating the drive roller 87 in reverse after the trailing edge of the recording paper has left the nip part between the drive roller 87 and pinch roller 88. Thus, even during abnormal cases in which the pinch roller holder 96 does not return to the retracted position E of θ=θ2, the pinch roller holder 96 is enable to roll toward the retracted position E of θ=θ2 by rotating the drive roller 87 in reverse.

$$M1(\theta)+M2>M3 \tag{8}$$

In this case, the moment M2 acts counterclockwise around the point A, and the moment M3 acts clockwise around the center O.

In the multifunction device 1 described above, the pinch roller holder 96 is rotatably supported via the rolling bearings 125. By providing the pinch roller 88, and pinch roller holder 96, holder support member 97, springs 131 to satisfy equations (4)-(8), it is possible to reduce the amount of force pushing the recording paper in the paper-conveying direction, Further, by determining angles ϕ1 and ϕ2 that satisfy the condition of equation (3) in order to set the conveying position D and the retracted position E, the construction of the multifunction device 1 prevents the trailing edge of the recording paper from being supported on the pinch roller 88 after leaving the conveying rollers 89. Hence, the recording paper S falls downward by its own weight. Accordingly, this construction prevents the recording paper from floating. As a result, this construction prevents the recording paper from contacting the recording head and becoming stained, and prevents a decline in the quality of the image recorded on the recording paper, particularly a decline in quality caused by distortions in the image on the trailing edge side of the recording paper.

Specifically, when a recording paper S is fed to the conveying rollers 89, the conveying rollers 89 grips the recording paper S and conveys the recording paper S toward the supporting surface 42*a* from a position above the supporting surface 42*a*. Hence, the recording paper S is pressed against the supporting surface 42*a* and is forcibly bent against the supporting surface 42*a* as the recording paper S advances along the surface. While the recording paper S is conveyed, the pinch roller holder 96 is positioned in the conveying position. When the trailing edge of the recording paper S subsequently leaves the conveying rollers 89, the pinch roller holder 96 is immediately moved from the conveying position to the retracted position upstream in the paper-conveying direction. The conveying position is set upstream of the line O-A, which is orthogonal to the supporting surface 42*a* and passes through the rotational axis of the drive roller 87. The retracted position is set to a position in which the surface of the pinch roller 88 does not intersect the vertical line passing through the point G1. Therefore, movement of the pinch roller 88 to the retracted position does not result in the pinch roller 88 supporting the trailing edge of the recording paper S. Even if the trailing edge of the recording paper S were supported on the pinch roller 88, this support would be only momentary. Therefore, since the pinch roller 88 does not interfere with the trailing edge of the forcibly bent recording paper S, the trailing edge drops down onto the paper support surface as the recording paper S attempts to return to its original unbent shape. By preventing the pinch roller 88 from interfering in the behavior of the trailing edge portion of the recording paper S in this way, the invention can prevent the recording paper S from rising upward The pinch roller holder 96 is rotated about the axis of the drive roller 87. Accordingly, smooth movement of the pinch roller 88 is achieved.

When the leading edge of the recording paper S arrives at the conveying rollers 89, the drive roller 87 and the pinch roller 88 grip the leading edge of the recording paper S. At this time, the pinch roller 88 compresses the coil spring 131 by a distance equivalent to the thickness of the paper, applying a force to the pinch roller holder 96 toward the conveying position. Receiving a reaction force to this force, the pinch roller holder 96 is shifted from the retracted position to the conveying position and maintained in the conveying position. When the drive roller 87 transmits a rotating force to the recording paper S the leading edge of which is gripped by the conveying rollers 89, the drive roller 87 begins conveying the recording paper S toward the supporting surface 42*a* from a position above the supporting surface 42*a*. As the recording paper S is conveyed further and the trailing edge of the recording paper S leaves the conveying rollers 89, a portion of the pressure force applied to the recording paper S in a direction orthogonal thereto is subsequently applied in the conveying direction due to the thickness of the recording paper S. This force transfers the pinch roller holder 96 from the conveying position to the retracted position and maintains the pinch roller holder 96 in the retracted position.

Since the pinch roller holder 96 is supported on the bearings 133 having a very small frictional force, nearly all of the reaction force to the force applied in the conveying direction acts to roll the pinch roller holder 96 from the conveying position to the retracted position. Hence, the pinch roller holder 96 rolls from the conveying position to the retracted position the instant the trailing edge of the recording paper S leaves the conveying rollers 89. Accordingly, the pinch roller 88, which can interfere with the recording paper S when the recording paper S attempts to return to its original flat form after the forced deformation is removed, is immediately retracted upstream in the paper-conveying direction, thereby more effectively preventing the trailing edge region of the recording paper S from floating upward.

The holder support member 97 includes the curved surface 136, the ribs 138, and the engaging grooves 134. Hence, through a simple construction the invention can support the pinch roller holder 96 and restrict rolling of the pinch roller holder 96. As a result, the support structure for the pinch roller 88 is simplified.

The bearings 125 include the rollers 126. Accordingly, the invention can implement a simple structure that can both roll and support the pinch roller holder 96. Further, the invention improves stability of the pinch roller holder 96 when supporting the same.

When the conveying rollers 89 is not conveying the recording paper S, the coil spring 131 of the pinch roller holder 96 applies an urging force to the pinch roller holder 96 for rolling the pinch roller holder 96 upstream in the conveying direction. As a result, the pinch roller holder 96 is rolled to and maintained in the retracted position. When the leading edge of the recording paper S arrives at the conveying rollers 89, the pinch roller 88 receives a force when the conveying rollers 89 grip the leading edge of the recording paper S. If this force is greater than the urging force of the coil spring 131 and the rolling frictional force, the pinch roller holder 96 rolls from the retracted position to the conveying position. As the conveying rollers 89 conveys the recording paper S, the pinch roller holder 96 is maintained in the conveying position by the sliding frictional force on the pinch roller 88, and by a portion of a force that the recording paper S applies to the pinch roller 88 in attempting to return to its original shape. When corners on the trailing edge of the recording paper S are in contact with the surface of both rollers, a moment is produced by the recording paper S contacting the pinch roller 88. This moment rotates the pinch roller 88 about the corner on the trailing edge of the recording paper S nearest the pinch roller 88. When the recording paper S is conveyed farther and the trailing edge leaves the conveying rollers 89, a gap is generated between the drive roller 87 and the pinch roller 88 while the coil spring 131 applies a force in a direction for closing this gap. A moment by this force moves the pinch roller holder 96 supporting the pinch roller 88 from the conveying position to the retracted position. At the beginning of this rolling movement, the static frictional force is reduced to a dynamic frictional force so that the rolling movement of the pinch roller holder 96 continues even after the trailing edge of the recording paper S no longer contacts the rollers, and the pinch roller holder 96 is moved to the retracted position. The degree of separation between the relative positions of the pinch roller holder 96 and the drive roller 87 is set appropriately according to the frictional force generated by the pinch roller holder 96, drive roller 87, and pinch roller 88 and the urging force applied by the coil spring 131.

According to the multifunction device 1, the trailing edge of the recording paper S is not supported on the pinch roller 88 when the trailing edge leaves the conveying rollers 89. Hence, the recording paper S falls downward by its own weight. Accordingly, the construction described above prevents the recording paper S from floating, prevents distortion in the image at the trailing edge region of the recording paper S, and prevents the trailing edge from contacting the recording head and becoming stained. This construction also avoids increasing the size of the device since there is no need to interpose the conventional paper-regulating device between the conveying rollers 89 and the supporting surface 42*a*.

While the invention has been described in detail with reference to specific aspects thereof, it would be apparent to those skilled in the art that many modifications and variations may be made therein without departing from the spirit of the invention, the scope of which is defined by the attached claims. For example, the image-recording device of the invention is not limited to a support structure for rolling the pinch rollers 88 with the pinch roller holder 96 supported on the holder support member 97, but may apply the sliding mechanism disclosed in Japanese unexamined patent application publication No. 2004-168451. The sliding mechanism disclosed in this publication supports a follow roller so that the follow roller can rotate and can slidingly move in the paper-conveying direction. When the trailing edge of the recording paper leaves the nip part between the drive roller and the follow roller, the follow roller retracts upstream in the paper-conveying direction due to the reaction force from the recording paper. More detail regarding this mechanism can be found in the above publication. The multifunction device 1 can also be applied to a pair of conveying rollers 89 that are constantly fixed to prescribed positions before and after conveying the recording paper, without moving the pinch rollers 88 by rolling or sliding.

In the multifunction device 1 described above, the center of revolution O is disposed on a vertical line passing through the point A. However, the center of revolution O may be disposed on the line A-B1 with the distance separating the center of revolution O and the curved surface 136 being greater than the distance separating a point B at the rotational center of the pinch rollers 88 and the curved surface 136.

What is claimed is:

1. A sheet-conveying device conveying a recording medium to a sheet support surface positioned downstream of the sheet-conveying device in a sheet-conveying direction when recording an image with an image-recording unit, the sheet-conveying device comprising:

a sheet-conveying unit having a drive roller and a follower roller defining a nip line therebetween, the nip line being positioned above the sheet support surface;

a first support member that rotatably supports the follower roller, and has an urging unit applying an urging force to the follower roller toward the drive roller to pinch the recording medium between the drive roller and the follower roller; and a second support member supporting the first support member and roller bearings, wherein the first support member is configured to move from a first position to a second position upstream of the first position in the paper-conveying direction immediately after a trailing edge of the recording medium leaves the sheet-conveying unit, wherein the first position is a position in which a rotational axis of the follower roller is disposed upstream in the paper-conveying direction of a first vertical plane orthogonal to the sheet support surface and including a rotational axis of the drive roller, the first position providing a first nip line between the drive roller and the follower roller;

wherein the second position provides a second nip line between the drive roller and the follower roller, the second nip line being upstream of the first nip line in the sheet conveying direction;

wherein the second position is a position in which the surface of the follower roller does not intersect a second vertical plane orthogonal to the sheet support surface and extending parallel to an axis of the follower roller and including the first nip line; and wherein the first support member is configured to move by the roller bearings and the roller bearings comprise a plurality of rotary bodies interposed in a freely rotating state between the supporting surface and the first support member.

2. The sheet-conveying device as claimed in claim 1, wherein the first support member is configured to move about the rotational axis of the drive roller.

3. The sheet-conveying device as claimed in claim 1, wherein the first support member is configured to move from the second position to the first position when the sheet-conveying unit conveys the recording medium, and the first support member is configured to move from the first position to the second position when the sheet-conveying unit no longer conveys the recording medium.

4. The sheet-conveying device as claimed in claim 1, wherein the second support member comprises:

a supporting surface supporting the first support member via the roller bearings;

a first restricting member restricting movement of the first support member to the sheet conveying direction at the first position; and a second restricting member restricting movement of the first support member to an opposite direction of the sheet conveying direction at the second position.

5. The sheet-conveying device as claimed in claim 1, wherein the second support member supports the first support member to separate the relative positions of the first support member and the drive roller as the first support member moves from the first position to the second position.

6. The sheet-conveying device as claimed in claim 5, wherein the second support member is configured to movably support the first support member along a substantially arcuate path about a center of revolution extending parallel to the rotational axis of the drive roller.

7. The sheet-conveying device as claimed in claim 6, wherein the center of revolution is positioned on the second position side of a plane that includes the rotational axis of the drive roller and the rotational axis of the follower roller in the first position.

8. The sheet-conveying device as claimed in claim 6, wherein the center of revolution is positioned on a plane that includes the rotational axis of the drive roller and the rotational axis of the follower roller in the first position.

9. The sheet-conveying device as claimed in claim 6, wherein the supporting surface of the second support member is shaped to conform substantially to the outer peripheral surface of a prescribed cylindrical path described around the center of revolution.

10. The sheet-conveying device as claimed in claim 1, wherein the follower roller includes a plurality of rollers; and wherein the first support member integrally supports the plurality of rollers at prescribed intervals along the axial direction of the drive roller.

11. An image-recording device comprising:

an image-recording unit;

a sheet support surface on which the image-recording unit records an image on a recording medium; and a sheet-conveying device conveying a recording medium to the sheet support surface positioned downstream of the sheet-conveying device in a sheet-conveying direction, the sheet-conveying device comprising:

a sheet-conveying unit having a drive roller and a follower roller defining a nip line therebetween, the nip line being positioned above the sheet support surface;

a first support member that rotatably supports the follower roller, and has an urging unit applying an urging force to the follower roller toward the drive roller to pinch the recording medium between the drive roller and the follower roller; and a second support member supporting the first support member and roller bearings, wherein the first support member is configured to move from a first position to a second position upstream of the first position in the paper-conveying direction immediately after a trailing edge of the recording medium leaves the sheet-conveying unit;

wherein the first position is a position in which a rotational axis of the follower roller is disposed upstream in the paper-conveying direction of a first vertical plane orthogonal to the sheet support surface and including a rotational axis of the drive roller, the first position providing a first nip line between the drive roller and the follower roller;

wherein the second position provides a second nip line between the drive roller and the follower roller, the second nip line being upstream of the first nip line in the sheet conveying direction;

wherein the second position is a position in which the surface of the follower roller does not intersect a second vertical plane orthogonal to the sheet support surface and extending parallel to an axis of the follower roller and including the first nip line; and wherein the first support member is configured to move by the roller bearings and the roller bearings comprise a plurality of rotary bodies interposed in a freely rotating state between the supporting surface and the first support member.

* * * * *